US011071377B2

(12) United States Patent
Lindblad et al.

(10) Patent No.: US 11,071,377 B2
(45) Date of Patent: Jul. 27, 2021

(54) HEIGHT ADJUSTABLE PLATFORMS AND ASSOCIATED MECHANISMS

(71) Applicant: Ergotron, Inc., St. Paul, MN (US)

(72) Inventors: Shaun Christopher Lindblad, Lino Lakes, MN (US); Jeffrey Randall Mensing, Blaine, MN (US); Thiem Chan Duong Wong, Brooklyn Park, MN (US); Mark Alan Kottman, Minneapolis, MN (US); Michael Anthony Apolloni, Inver Grove Heights, MN (US); David James Prince, Saint Paul, MN (US); George Charles Willard Runger, Chandler, AZ (US)

(73) Assignee: Ergotron, Inc., St. Paul, MN (US)

( * ) Notice: Subject to any disclaimer, the term of this patent is extended or adjusted under 35 U.S.C. 154(b) by 0 days.

(21) Appl. No.: 16/290,766

(22) Filed: Mar. 1, 2019

(65) Prior Publication Data

US 2019/0269236 A1 Sep. 5, 2019

Related U.S. Application Data

(60) Provisional application No. 62/637,599, filed on Mar. 2, 2018.

(51) Int. Cl.

| | |
|---|---|
| ***A47B 9/08*** | (2006.01) |
| ***A47B 21/02*** | (2006.01) |
| ***A47B 9/02*** | (2006.01) |

(52) U.S. Cl.

CPC ..... *A47B 9/08* (2013.01); *A47B 9/02* (2013.01); *A47B 21/02* (2013.01)

(58) Field of Classification Search

CPC .. A47B 9/08; A47B 21/02; A47B 9/02; A47B 2013/027; A47B 2200/0022; A47B 2200/0076; A47B 2013/025; A47B 9/12

See application file for complete search history.

(56) References Cited

U.S. PATENT DOCUMENTS 741,382 A 10/1903 Seifried
874,014 A 12/1907 Kurtzon
(Continued)

FOREIGN PATENT DOCUMENTS

AU 2015224380 A1 9/2015
AU 2015224380 B2 9/2015
(Continued)

OTHER PUBLICATIONS

"U.S. Appl. No. 16/855,784, Preliminary Amendment filed Jul. 30, 2020", 8 pgs.
(Continued)

*Primary Examiner* — Hanh V Tran
(74) *Attorney, Agent, or Firm* — Schwegman Lundberg & Woessner, P.A.

(57) ABSTRACT

A height adjustable platform can include a work surface, a lock rod, and can include a brake assembly. The brake assembly can be sized and shaped to receive the lock rod. The brake assembly can be adapted to couple with the work surface. The brake assembly can be adapted to selectively translate with respect to the lock rod.

The brake assembly can include a first torsion spring having a first inner portion and can include a second torsion spring having a second inner portion. The first inner portion and the second inner portion can be sized and shaped to receive the lock rod. The first inner portion can selectively engage with the lock rod. The second inner portion can selectively engage with the lock rod. The brake assembly can include a locked configuration, an unlocked configuration, and can include a safety configuration.

14 Claims, 22 Drawing Sheets

(56) References Cited

U.S. PATENT DOCUMENTS 1,034,365 A 7/1912 Hauser
1,958,980 A 5/1934 Vaughan
3,845,728 A 11/1974 Piretti
4,353,263 A 10/1982 Ciciora
4,457,406 A * 7/1984 Porter ..... F16B 7/1481 188/67
4,969,403 A 11/1990 Schwartz et al.
5,219,045 A * 6/1993 Porter ..... F16B 7/1481 188/67
5,441,129 A * 8/1995 Porter ..... B60N 2/23 188/67
5,454,638 A 10/1995 Bird et al.
5,472,103 A 12/1995 Merl
5,538,213 A 7/1996 Brown
5,568,843 A * 10/1996 Porter ..... B60N 2/23 188/67
5,673,633 A 10/1997 Pfister
5,706,739 A * 1/1998 Shaheen ..... A47B 9/02 108/146
5,794,470 A * 8/1998 Stringer ..... B60N 2/23 188/67
5,927,214 A 7/1999 Schwartz et al.
6,164,419 A * 12/2000 Tribbett ..... B60N 2/929 188/67
6,276,660 B1 * 8/2001 Wittkopp ..... F15B 13/0406 251/313
6,286,441 B1 * 9/2001 Burdi ..... A47B 9/00 108/147
6,315,361 B1 * 11/2001 Stone ..... B60N 2/0248 297/362.12
6,336,618 B1 1/2002 Barber
6,460,816 B1 10/2002 Barber
6,575,531 B1 * 6/2003 Tseng ..... A47C 1/0325 267/155
6,584,917 B2 * 7/2003 Long ..... A47B 9/00 108/147
6,598,844 B2 7/2003 Barber
6,726,168 B2 4/2004 Barber
6,832,560 B2 12/2004 Seiler et al.
6,851,226 B2 2/2005 MacGregor et al.
6,905,101 B1 6/2005 Dittmer
7,395,996 B2 7/2008 Dittmer
7,398,950 B2 7/2008 Hung
7,487,943 B1 2/2009 Gillespie
7,571,883 B2 8/2009 Van Groesen et al.
7,677,518 B2 3/2010 Chouinard et al.
7,766,311 B2 * 8/2010 Kossett ..... E05B 53/003 267/154
7,793,903 B2 9/2010 Dittmer et al.
7,828,253 B2 11/2010 Meyer
7,836,833 B2 11/2010 Kumazawa
7,878,470 B2 2/2011 Oh et al.
7,954,780 B2 6/2011 Dittmer
8,072,739 B2 12/2011 Dittmer
8,113,076 B2 2/2012 Daul
8,245,990 B2 8/2012 Huang
8,286,977 B2 10/2012 Butler et al.
8,408,365 B2 * 4/2013 Biasiotto ..... F16C 11/103 188/67
8,490,934 B2 7/2013 Dittmer
8,693,172 B2 4/2014 Russell et al.
8,947,215 B2 2/2015 Mandel et al.
9,004,430 B2 4/2015 Conner
9,027,940 B2 5/2015 Ergun et al.
9,039,016 B2 5/2015 Abernethy et al.
9,161,617 B2 10/2015 Fish
9,167,894 B2 10/2015 Desroches et al.
9,232,855 B2 * 1/2016 Ergun ..... A47B 9/12
9,416,911 B2 8/2016 Segar et al.
9,451,931 B2 9/2016 Ninomiya et al.
9,549,609 B2 1/2017 Constantino et al.
9,596,929 B2 3/2017 Koulizakis
9,775,430 B2 10/2017 Abu-akel et al.
9,855,109 B2 1/2018 Dekel
9,999,971 B2 6/2018 Charlton et al.
10,024,053 B2 7/2018 Diekröger
10,058,173 B2 8/2018 Umstead
10,092,092 B2 10/2018 Koch
10,323,791 B1 6/2019 Liu
10,376,042 B1 8/2019 Johnson et al.
10,376,158 B2 8/2019 Desroches
10,426,261 B2 10/2019 Theis et al.
10,646,033 B2 * 5/2020 Lindblad ..... F16M 11/24
2003/0178541 A1 * 9/2003 Barber ..... A47B 21/0314 248/284.1
2005/0018364 A1 1/2005 Gill
2005/0263465 A1 12/2005 Chung
2005/0288571 A1 12/2005 Perkins et al.
2006/0130713 A1 * 6/2006 Jones ..... A47B 9/20 108/106
2006/0185563 A1 * 8/2006 Sweere ..... F16M 11/10 108/28
2007/0227409 A1 10/2007 Chu
2007/0228680 A1 * 10/2007 Reppert ..... A61J 7/0069 280/47.35
2008/0084147 A1 4/2008 Brown
2008/0250989 A1 * 10/2008 Kozlowski ..... F16M 13/00 108/147
2009/0315287 A1 12/2009 Rossini
2010/0172072 A1 7/2010 Monaco
2010/0252521 A1 10/2010 Chen
2011/0146541 A1 6/2011 Griepentrog et al.
2012/0019990 A1 * 1/2012 Segar ..... F16M 11/22 361/679.01
2012/0119040 A1 * 5/2012 Ergun ..... A47B 97/06 248/126
2012/0236496 A1 9/2012 Mcrorie
2012/0255925 A1 10/2012 Fernandez
2013/0146728 A1 6/2013 Ergun et al.
2014/0084558 A1 3/2014 Ergun et al.
2014/0104806 A1 4/2014 Segar et al.
2015/0282607 A1 10/2015 Lager
2015/0313378 A1 11/2015 Mason
2016/0015167 A1 1/2016 Abu-akel et al.
2016/0037907 A1 2/2016 Ergun
2016/0278514 A1 9/2016 Maas
2017/0196352 A1 * 7/2017 King ..... A47B 21/0314
2017/0340102 A1 * 11/2017 Ergun ..... A47B 9/02
2019/0269239 A1 9/2019 Lindblad et al.
2020/0352321 A1 11/2020 Kottman et al.

FOREIGN PATENT DOCUMENTS

CN 111836567 A 10/2020
CN 112165886 A 1/2021
DE 102013114289 A1 6/2015
DE 112019001101 T5 11/2020
DE 112019001110 T5 11/2020
EP 0218990 A2 4/1987
EP 2856909 A1 8/2015
JP 1017927 A 1/1998
JP H1017927 A 1/1998
WO WO-9205332 A1 4/1992
WO WO-0106892 A1 5/2001
WO WO-2010054430 A1 5/2010
WO WO-2016128765 A1 8/2016
WO WO-2019169346 A1 9/2019
WO WO-2019169355 A1 9/2019

OTHER PUBLICATIONS

"International Application Serial No. PCT/US2019/020424, International Preliminary Report on Patentability dated Sep. 17, 2020", 9 pgs.
"International Application Serial No. PCT/US2019/020435, International Preliminary Report on Patentability dated Sep. 17, 2020", 6 pgs.
"U.S. Appl. No. 16/290,840, Non Final Office Action dated Oct. 11, 2019", 7 pgs.
"U.S. Appl. No. 16/290,840, Notice of Allowance dated Feb. 4, 2020", 9 pgs.

(56) References Cited

OTHER PUBLICATIONS

"International Application Serial No. PCT/US2019/020424, International Search Report dated Jun. 24, 2019", 4 pgs.
"International Application Serial No. PCT/US2019/020424, Invitation to Pay Additional Fees and Partial Search Report dated Apr. 17, 2019", 2 pgs.
"International Application Serial No. PCT/US2019/020424, Written Opinion dated Jun. 24, 2019", 7 pgs.
"International Application Serial No. PCT/US2019/020435, International Search Report dated May 16, 2019", 2 pgs.
"International Application Serial No. PCT/US2019/020435, Written Opinion dated May 16, 2019", 4 pgs.
"U.S. Appl. No. 16/855,784, Non Final Office Action dated Dec. 17, 2020", 7 pgs.
"Chinese Application Serial No. 201980016854.X, Notification to Make Rectification dated Sep. 17, 2020", w/o English Translation, 2 pgs.
"U.S. Appl. No. 16/855,784, Notice of Allowance dated Mar. 26, 2021", 5 pgs.
"U.S. Appl. No. 16/855,784, Response filed Mar. 16, 2021 to Non Final Office Action dated Dec. 17, 2020", 12 pgs.

* cited by examiner

HEIGHT ADJUSTABLE PLATFORMS AND ASSOCIATED MECHANISMS

CLAIM OF PRIORITY

This patent application claims the benefit of priority of Lindblad, et al. U.S. Provisional Patent Application Ser. No. 62/637,599, entitled "HEIGHT ADJUSTABLE PLATFORMS AND ASSOCIATED MECHANISMS," filed on Mar. 2, 2018, which is hereby incorporated by reference herein in its entirety.

TECHNICAL FIELD

This document pertains generally, but not by way of limitation, to height adjustable work surfaces.

BACKGROUND

Conventional desks include a planar desktop providing a work surface and for receiving a computer monitor, computer peripherals or other desktop items. Typically, the desktop is mounted at a horizontal position to provide a flat surface for receiving and retaining desktop items. Similarly, the desktop is positioned at a height that corresponds to a position at which a seated person can comfortably use the desk. Recently, desk users have sought to use desks while standing to prevent back strain and other injuries that result from extended seated use of the desk and in particular computer use, which often results in the user being hunched over the desktop. In particular, recent information has indicated that alternating between standing and sitting while using a desk for extending periods of time has beneficial health benefits.

SUMMARY

A height adjustable platform can include a work surface. The height adjustable platform can include a lock rod and can include a brake assembly. The brake assembly can be sized and shaped to receive the lock rod. The brake assembly can be adapted to couple with the work surface. The brake assembly can be adapted to selectively translate with respect to the lock rod.

The brake assembly can include a first torsion spring having a first inner portion. The brake assembly can include a second torsion spring having a second inner portion. The first inner portion and the second inner portion can be sized and shaped to receive the lock rod. The first torsion spring can be adapted such that the first inner portion selectively engages with the lock rod. The second torsion spring can be adapted such that the second inner portion selectively engages with the lock rod.

The brake assembly can include a locked configuration, an unlocked configuration, and can include a safety configuration. In the locked configuration, the first inner portion can be engaged with the lock rod. The engagement of the first inner portion with the lock rod can help prevent the translation of the brake assembly with respect to the lock rod. In the unlocked configuration, the first inner portion can be disengaged from the lock rod. The disengagement of the first inner portion from the lock rod can allow the translation of the brake assembly with respect to the lock rod. In the safety configuration, the second inner portion can be engaged with the lock rod, irrespective of whether the first inner portion is engaged with the lock rod. The engagement of the second inner portion with the lock rod can help prevent the translation of the brake assembly with respect to the lock rod.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

A height of a work surface can be adjustable with respect to a user (e.g., the user is able to raise and lower the work surface). A counterbalance mechanism can be coupled to the work surface. The counterbalance mechanism can support the work surface, such as by helping the user adjust the work surface, and thereby reducing the effort required by the user to adjust the work surface.

As discussed in further detail in this disclosure, a brake assembly can be coupled to the work surface. The brake assembly can include a locked configuration, an unlocked configuration, and can include a safety configuration. The brake assembly can engage the safety configuration irrespective of whether the brake assembly is engaging the locked configuration or the unlocked configuration.

Figure 1:
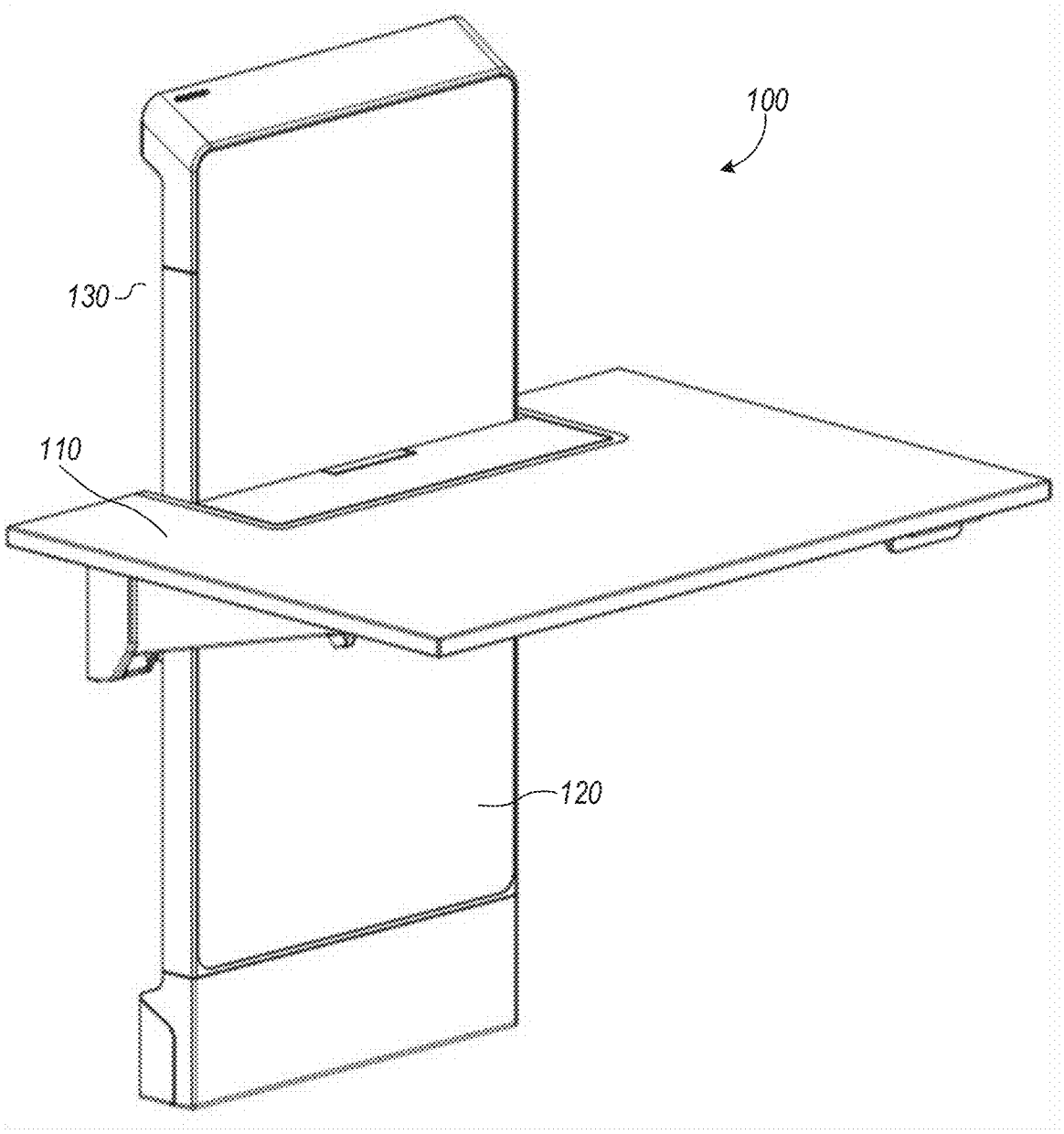
FIG. 1 is a perspective view of one example of a height adjustable platform.

FIG. 1 is a perspective view of one example of a height adjustable platform 100. The height adjustable platform 100 can include a work surface 110 and can include a riser 120. The riser 120 can be adapted to couple with a support structure 130 (e.g., a wall, a cubicle wall, a free-standing frame, or the like). The riser 120 can define mounting holes adapted to couple the riser 120 with the support structure 130. The work surface 110 can be coupled with the riser 120 such that the work surface 110 is able to translate with respect to the riser 120.

Figure 2:
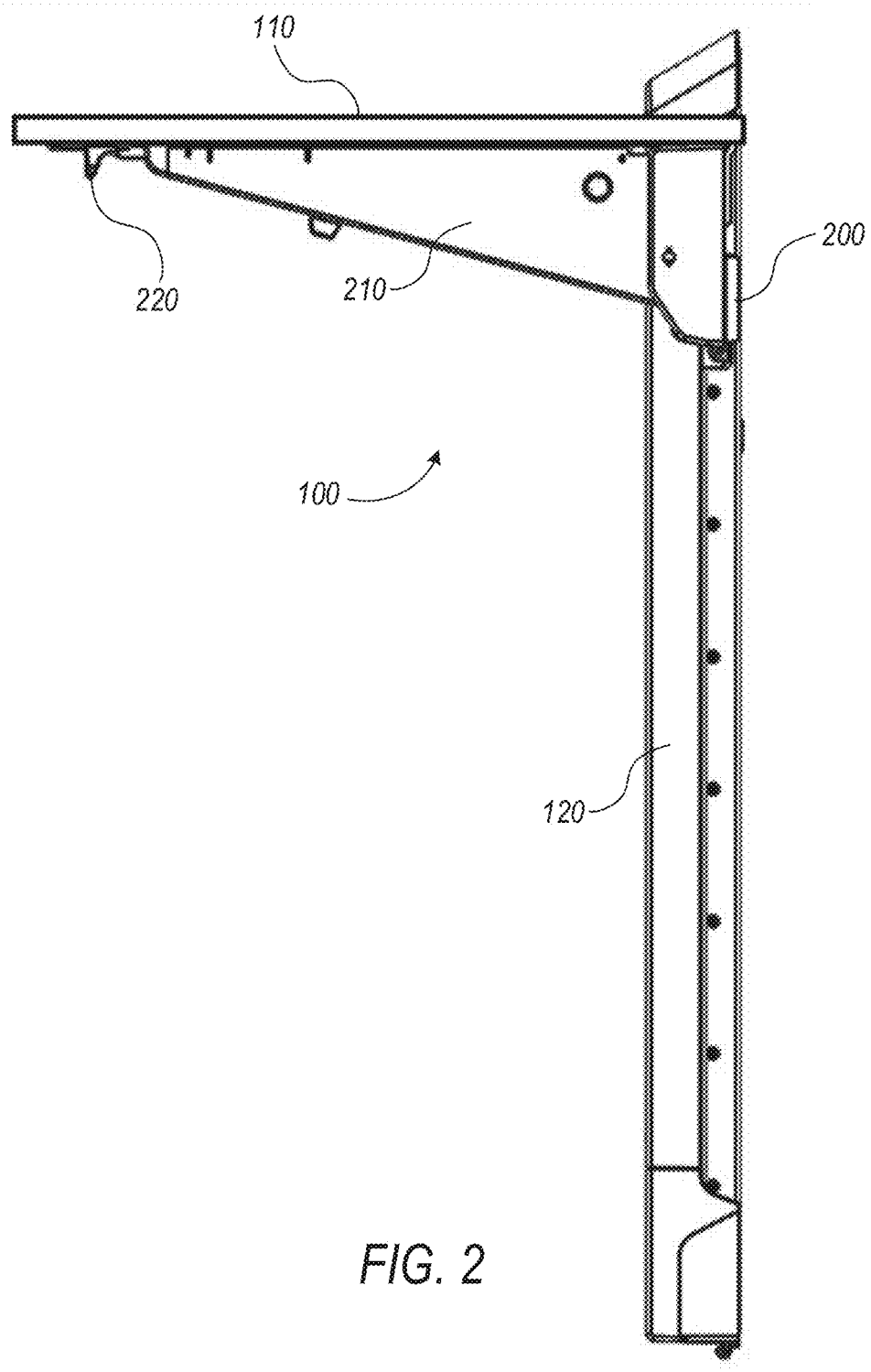
FIG. 2 is a side view of the height adjustable platform of FIG. 1.

FIG. 2 is a side view of the height adjustable platform 100 of FIG. 1. The height adjustable platform 100 can include a sliding bracket 200. The sliding bracket 200 can be moveably coupled with the riser 120 such that the sliding bracket 200 is adapted to translate with respect to the riser 120.

The height adjustable platform 100 can further include a support bracket 210. The support bracket 210 can be coupled with the sliding bracket 200. The support bracket 210 can be adapted to couple with the work surface 110. Coupling the work surface 110 to the support bracket 210 can help the work surface 110 translate with respect to the riser 120.

The height adjustable platform 100 can be adapted such that the work surface 110 is able to be positioned at a plurality of heights with respect to the riser 120. As described in this disclosure, the height adjustable platform 100 can include a brake assembly (e.g., the brake assembly 550 shown in FIGS. 5-11). The brake assembly can be adapted to secure (e.g., fix, lock, position, or the like) the work surface 110 at one of the plurality of heights with respect to the riser 120. Securing the work surface 110 at one of the plurality of heights can substantially prevent the translation of the work surface 110 with respect to the riser 120.

The height adjustable platform 100 can include an actuator 220. The actuator 220 can be sized and shaped (e.g., to include a handle) to allow a user to interact with (e.g., grasp, pull, push, twist, or the like) the actuator 220. The actuator 220 can be adapted such that user-interaction with the actuator 220 disengages the brake assembly (e.g., the brake assembly 1300 shown in FIGS. 13-16), and thereby allows the work surface 110 to translate with respect to the riser 120.

Figure 3:
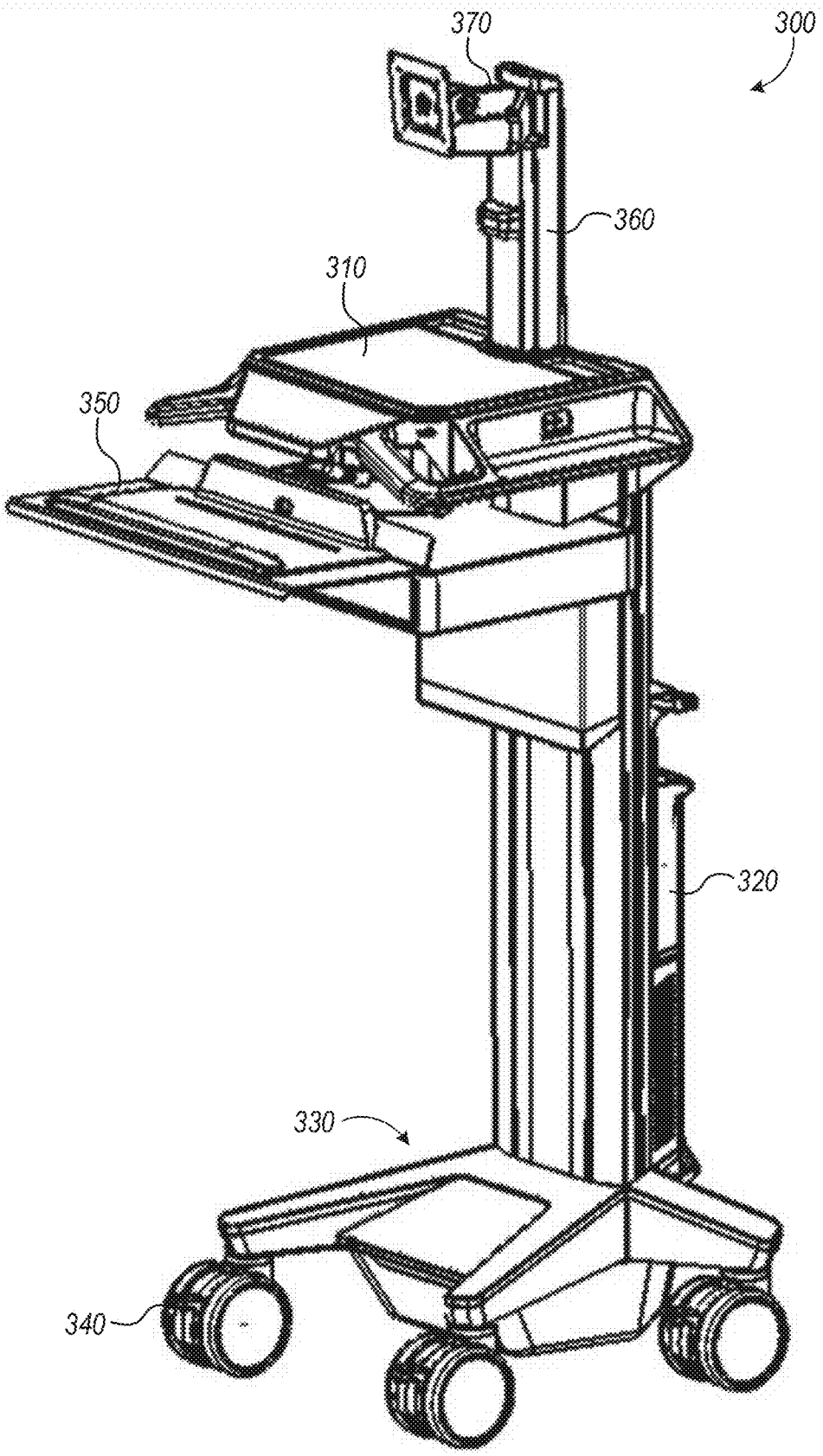
FIG. 3 is a perspective view of another example of a height adjustable platform.

FIG. 3 is a perspective view of another example of a height adjustable platform 300. The height adjustable platform 300 can include a work surface 310 and can include a riser 320. The work surface 310 can be coupled with the riser 320 such that the work surface 310 is able to translate with respect to the riser 320 (or translate with respect to portions of the riser 320, for instance the riser chassis 1210 shown in FIG. 12). As described in this disclosure, the height adjustable platform 300 can include a brake assembly (e.g., the brake assembly 1300 shown in FIGS. 13-16). The brake assembly can help prevent the translation of the work surface 310 with respect to the riser 320.

The riser 320 can be adapted to couple with a support structure, such as a wheeled base 330. The wheeled base 330 can provide a support structure for the height adjustable platform 300. The wheeled base 330 can help the height adjustable platform 300 translate along a surface, such as a floor. In some example implementations, the wheeled base 330 can include a lock 340 that can be adapted to substantially prevent the wheeled base 330 from translating along the surface.

In some example, the height adjustable platform 300 can include a secondary work surface 350, e.g., a keyboard tray. The secondary work surface 350 can be adapted to support input devices (e.g., a keyboard, a mouse, a touchpad, or the like).

The height adjustable platform 300 can include a display riser 360. The display riser 360 can be adapted to couple with a display (e.g., a computer monitor, such as an LCD or LED display). The display riser 360 can include a display arm 370. The display arm 370 can be adapted to help position (e.g., change the orientation of) the display with respect to the display riser 360, such as to help a user to view the display.

Figure 4:
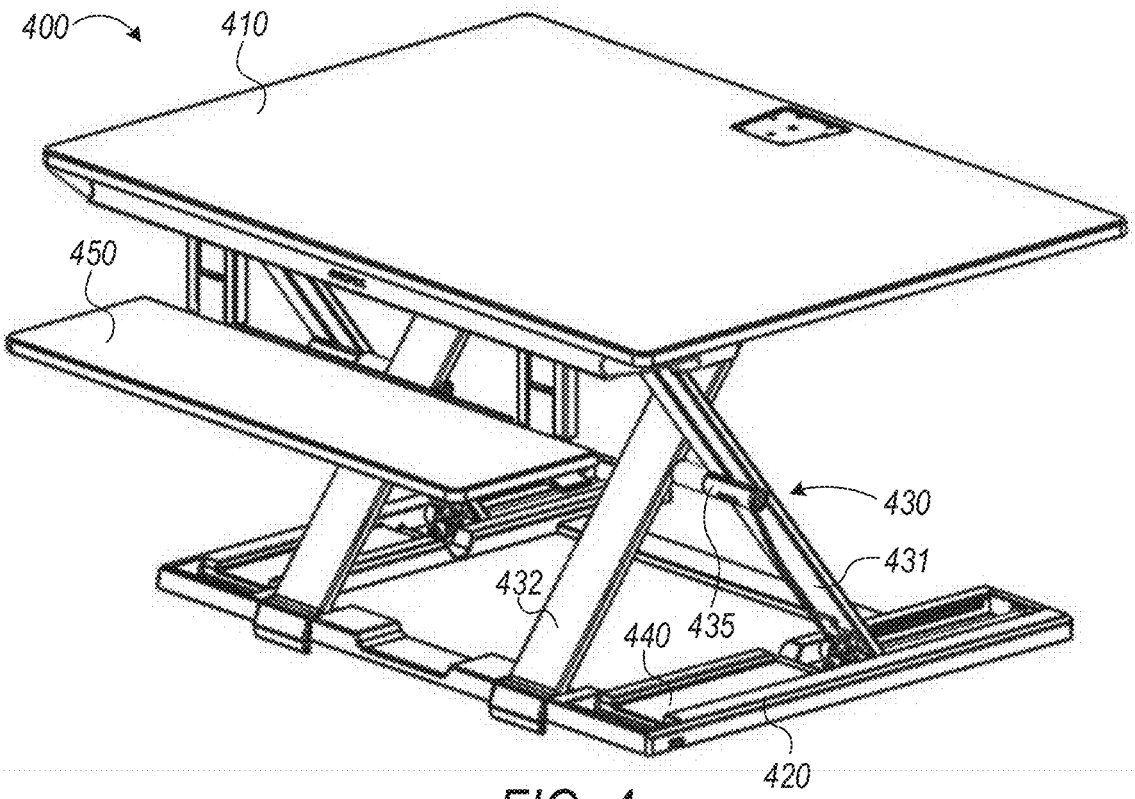
FIG. 4 is a perspective view of yet another example of a height adjustable platform.

FIG. 4 is a perspective view of yet another example of a height adjustable platform 400. The height adjustable platform 400 can include a work surface 410.

The height adjustable platform 400 can include a foot assembly 420. The foot assembly can be adapted to rest upon a foundation (e.g., a floor, a desktop, or the like). As described in this disclosure, the height adjustable platform 400 can include a brake assembly (e.g., the brake assembly 1700 shown in FIGS. 17-19).

The height adjustable platform 400 can include a leg assembly 430. The leg assembly 430 can include a first set of legs. The first set of legs can be adapted such that a first leg 431 is rotatably coupled (e.g., about a hinge 435) with a second leg 432. Displacement of the first leg 431 (e.g., rotating the first leg 431 relative to the second leg 432) can cause a change in height of the first set of legs. The leg assembly can include one or more sets of legs, including the first set of legs. The leg assembly 430 can be coupled to the work surface 410. The leg assembly 430 can be coupled to the foot assembly 420. The leg assembly 430 can be adapted to help the work surface 410 to translate with respect to the foot assembly 420. The height adjustable platform 400 can be adapted such that the work surface 410 is able to be positioned at a plurality of heights with respect to the foot assembly 420.

Translation of the leg assembly 430 with respect to the foot assembly 420 can cause a corresponding translation (e.g., raising or lowering) of the work surface 410. The leg assembly 430 can translate within the foot assembly 420, and thereby cause the corresponding translation of the work surface 410. The foot assembly 420 can include a track 440. The track 440 can be sized and shaped to allow the leg assembly 430 to translate within (e.g., slide within) the track 440. The foot assembly can include one or more tracks, including the track 440.

The height adjustable platform 400 can include a secondary work surface 450. The secondary work surface 450 can be adapted to support input devices (e.g., a keyboard, a mouse, a touchpad, or the like). The height adjustable platform 400 can be adapted such that a change in height of the work surface 410 causes a corresponding change in height of the secondary work surface 450.

Figure 5:
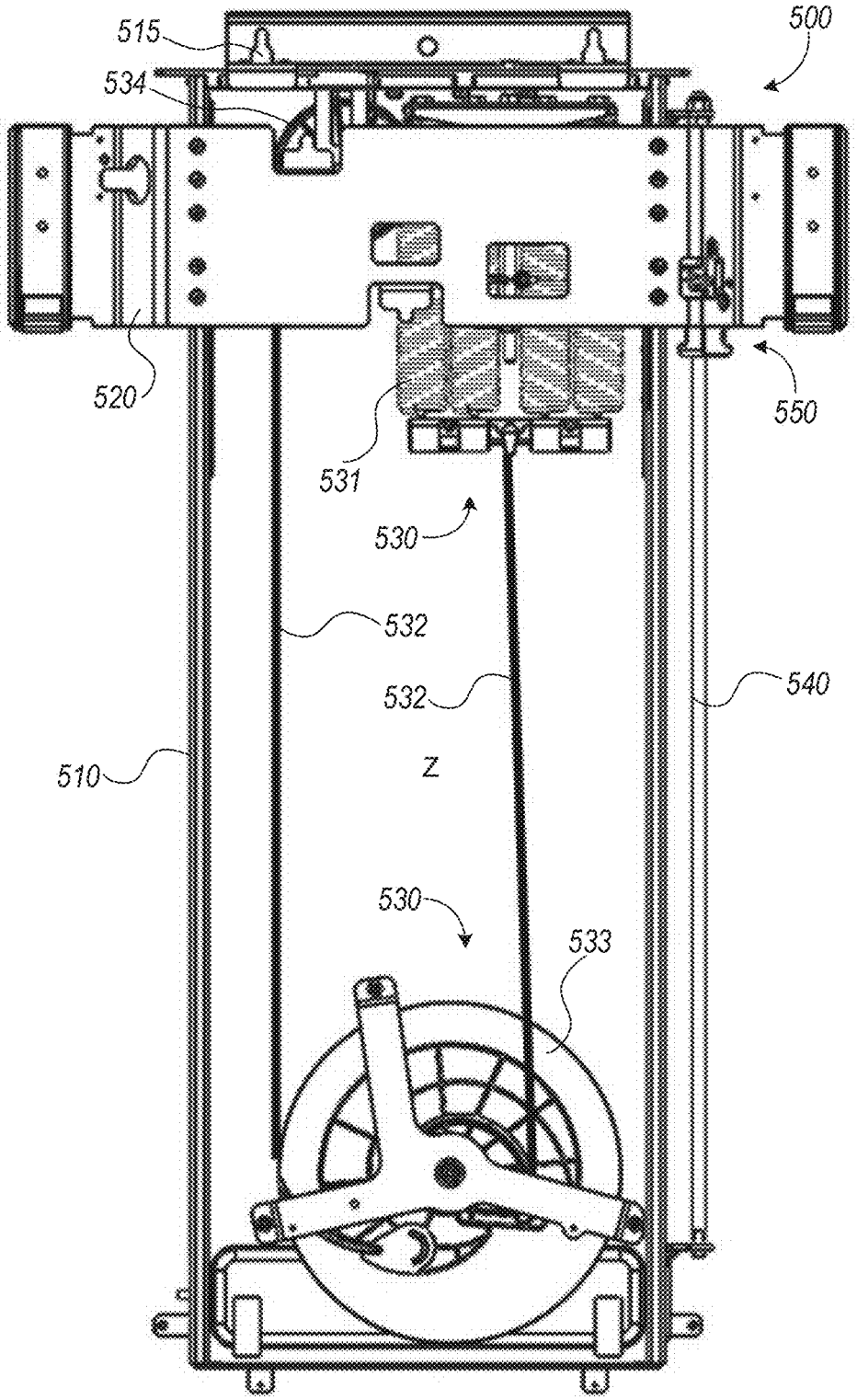
FIG. 5 is a front view of one example of a riser.

FIG. 5 is a front view of one example of a riser 500. The riser 500 can be included in a height adjustable platform (e.g., the height adjustable platform 100 or the height adjustable platform 300). The riser 500 can include a riser chassis 510. The riser chassis 510 can define one or more mounting features, such as a mounting hole 515. The mounting features can be adapted to help couple (e.g., affix, attach, or the like) the riser 500 with a support structure (e.g., a wall, a cubicle wall, a free-standing frame, or the like). The riser chassis 510 can be adapted to house, and otherwise support, components of a height adjustable platform (e.g., the height adjustable platform 100 of FIGS. 1-2).

The riser 500 can include a sliding bracket 520. The sliding bracket 520 can be adapted to couple with, and thereby support, components of a height adjustable platform, such as the work surface 110 of FIGS. 1-2. The sliding bracket 520 can be moveably coupled with the riser chassis 510 such that the sliding bracket 520 is adapted to translate with respect to the riser chassis 510. A portion of the sliding bracket 520 can engage with a portion of the riser chassis 510, and thereby moveably couple the sliding bracket 520 with the riser chassis 510. In an example, the riser chassis 510 defines a keyway and the sliding bracket 520 includes a key. The keyway can be sized and shaped to receive the key. The key can be sized and shaped to engage with the keyway. The engagement of the key with the keyway can help moveably couple the sliding bracket 520 with the riser chassis 510.

As described in this disclosure, the sliding bracket 520 can translate with respect to the riser chassis 510, e.g., linear translation, which can change the height of the sliding bracket 520 (and components attached to the sliding bracket 520, such as the work surface 110 of FIGS. 1-2).

The riser 500 can include a counterbalance mechanism 530. The counterbalance mechanism 530 can include one or more springs 531. The counterbalance mechanism 530 can include a wheel cable 532 (e.g., a tensile member). One end of the wheel cable 532 can be coupled to the sliding bracket 520, and the other end of the wheel cable 532 can be coupled to the one or more springs 531. The counterbalance mechanism 530 can include a wheel/cam assembly 533. The wheel cable 532 can engage with a portion of the wheel/cam assembly 533. Additionally, the wheel cable 532 can engage with a pulley 534.

In another example, the counterbalance mechanism can include a plurality of wheel cables 532. For instance, one end of a first wheel cable 532 can be coupled to the sliding bracket 520, and the other end of the first wheel cable 532 can be coupled to the wheel/cam assembly 533. A second wheel cable 532 can be coupled between the wheel/cam assembly 533 and the one or more springs 531.

Referring again to FIG. 5, the springs 531, the wheel cable 532, and the wheel/cam assembly 533 can cooperate to help counterbalance a force applied to the sliding bracket 520. Counterbalancing the force applied to the sliding bracket 520 can help maintain the amount of force required to translate the sliding bracket 520 with respect to the riser chassis 510. Stated another way, the counterbalance mechanism 530 can be adapted to support the sliding bracket 520 such that the amount of force necessary to translate the sliding bracket 520 with respect to the riser chassis 510 remains substantially constant, despite increasing force created by one or more springs during translation. Additionally, the counterbalance mechanism 530 can help maintain a position of the sliding bracket 520 with respect to the riser chassis 510, such as by providing a lift force equivalent to the combined weight of the sliding bracket 520 and all the components connected to it, including (but not limited to) the worksurface 110.

In an example, the sliding bracket 520 is coupled to the counterbalance mechanism 530 and the work surface 110 (shown in FIGS. 1-2). For example, a user can place a fifteen-pound object on the work surface 110, and the counterbalance mechanism 530 can help maintain the position (e.g., height) of the sliding bracket 520 (and thereby the work surface 110) with respect to the user. Moreover, if the user desires to change the position of (e.g., raise or lower) the work surface 110, the counterbalance mechanism 530 helps maintain the amount of force necessary to change the position of the sliding bracket 520 (and thereby the work surface 110) such that the amount of force necessary to change the position of the sliding bracket 520 with respect to the riser chassis 510 is substantially the same whether or not the fifteen-pound load is applied to the work surface 110.

Referring again to FIG. 5, and described in further detail in this disclosure, the riser 500 can include a lock rod 540. The lock rod 540 can be coupled to the riser chassis 510. Although the lock rod 540 can be positioned internally within, or externally of, the riser chassis 510, the specific configuration depicted in FIG. 5 depicts the lock rod 540 positioned an external side of the riser chassis 510. The lock rod 540 can be spaced from the riser chassis 510 at a first distance (e.g., a gap can exist between the lock rod 540 and the riser chassis 510). The lock rod 540 can have a circular, square, rectangular, other geometric shape, or irregular cross-section (e.g., the lock rod 540 can define a keyway).

As described in further detail in this disclosure, the riser 500 can include a brake assembly 550. The brake assembly 550 can be sized and shaped to receive the lock rod 540. The brake assembly 550 can be adapted to selectively translate with respect to (e.g., along) the lock rod 540. The brake assembly 550 can be coupled to, or included in, the sliding bracket 520. The brake assembly 550 can help maintain the position of the sliding bracket 520 with respect to the riser chassis 510. The brake assembly 550 can be coupled to a work surface, such as the work surface 110 (shown in FIGS. 1-2). The brake assembly 550 can be adapted to couple with the work surface, such as indirectly with the sliding bracket 520 or directly to the work surface. The brake assembly 550 can help maintain the position of the work surface with respect to the riser 500. In an example, the brake assembly 550 can translate in a first direction (e.g., vertically) with respect to the lock rod 540. The translation of the brake assembly 550 in the first direction can correspondingly cause the work surface to translate in the first direction.

Figure 6:
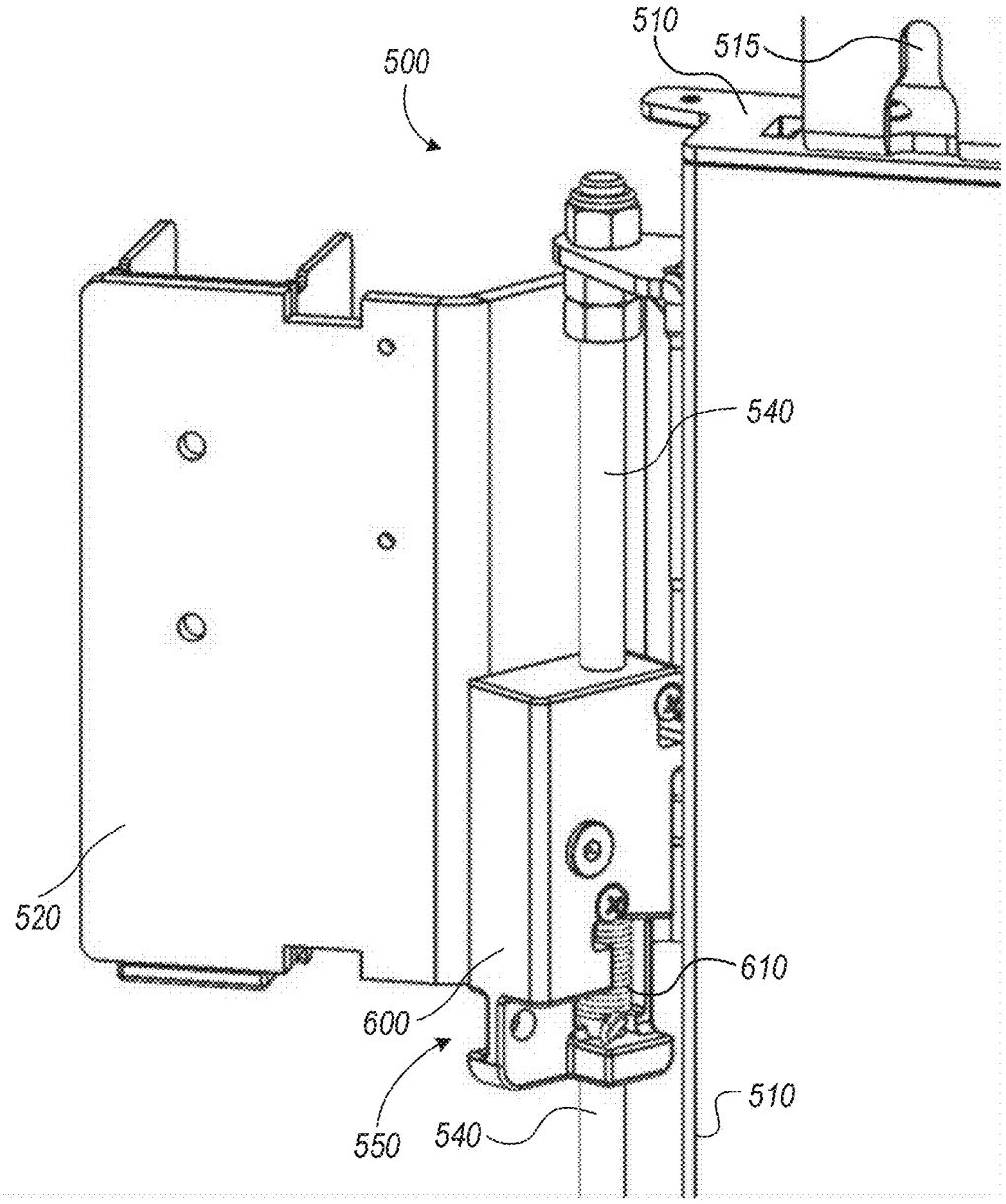
FIG. 6 is a perspective view of one example of the riser of FIG. 5, including a brake assembly.

FIG. 6 is a perspective view of one example of the riser 500 of FIG. 5, including the brake assembly 550. The brake assembly 550 can include a brake body 600. The brake body 600 can be adapted to couple with the sliding bracket 520 (e.g., the brake body is assembled to the sliding bracket 520). The sliding bracket 520 can define a portion of the brake body 600. The brake assembly 550 can be sized and shaped to receive the lock rod 540. The brake body 600 can be sized and shaped to receive the lock rod 540.

The brake assembly 550 can selectively translate with respect to the lock rod 540. The brake assembly 550 can include a first torsion spring 610. The first torsion spring 610 can help the brake assembly 550 selectively translate with respect to the lock rod 540.

Figure 7:
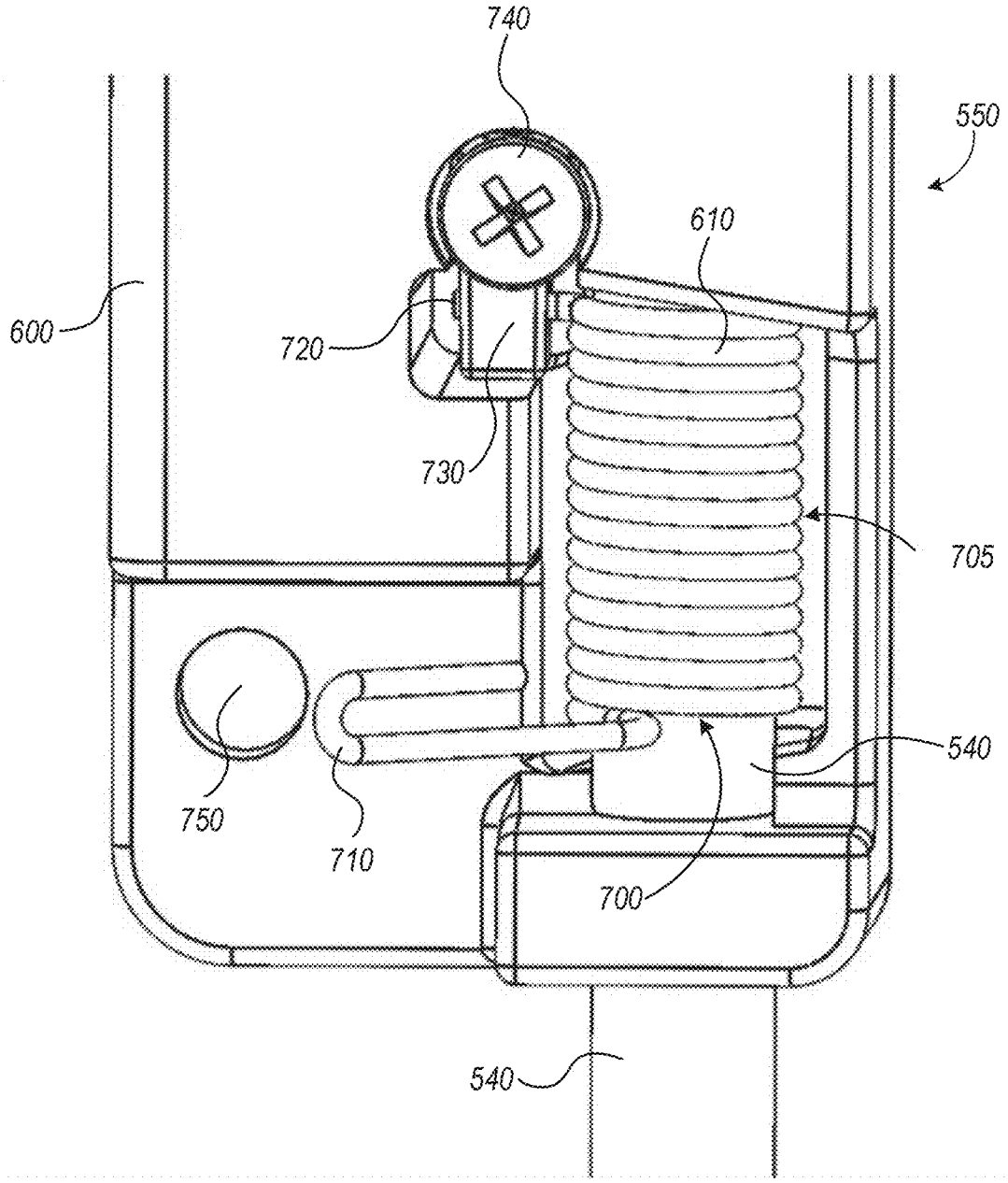
FIG. 7 is an enhanced perspective view of the brake assembly of FIG. 6.

FIG. 7 is an enhanced perspective view of the brake assembly 550 of FIG. 6. The first torsion spring 610 can include a number of coils 705 and a first inner portion 700 that can be defined by an inner surface of the coils 705. An outer surface of the coils 705 of the first torsion spring 610 are shown in FIG. 7.

The first inner portion 700 can be sized and shaped to receive the lock rod 540. The first torsion spring 610 can be adapted such that engagement with the first torsion spring 610 causes a dimension of the first inner portion 700 to change. The first torsion spring 610 can include a first leg 710. The first torsion spring 610 can be biased such that the first leg 710 is biased in a first direction with respect to the brake body 600. The first torsion spring 610 can be biased such that the first inner portion 700 is engaged with (or disengaged from) the lock rod 540.

As described further in this disclosure, engagement (e.g., displacement or translation) with the first leg 710 of the first torsion spring 610 can change the dimension of the first inner portion 700. Engagement with the first leg 710 can overcome the bias of the first torsion spring 610. The first inner portion 700 can have a relaxed state (e.g., there is no engagement with the first torsion spring 610) and a relaxed dimension (e.g., a first diameter) in the relaxed state. The first leg 710 can be engaged with, and can thereby strain, the first torsion spring 610. The engagement with the first leg 710, and straining of the first torsion spring 610, can change the first inner portion 700 to a strained dimension (e.g., a second diameter).

The strained dimension can be greater than the relaxed dimension.

The first torsion spring 610 can be adapted such that the first inner portion 700 selectively engages with the lock rod 540. Changing the dimension of the first inner portion 700 can help the first inner portion 700 to selectively engage with the lock rod 540. The engagement of the first inner portion 700 with the lock rod 540 can help prevent (e.g., substantially inhibit, impede, or stop) the translation of the brake assembly 550 with respect to the lock rod 540.

The brake assembly 550 can include an unlocked configuration and a locked configuration. In the unlocked configuration, the first inner portion 700 can be disengaged from the lock rod 540, such as to allow the translation of the brake assembly 550 with respect to the lock rod 540. As discussed in this disclosure, the first inner portion 700 can have a relaxed dimension and a strained dimension. The lock rod 540 can have a lock rod dimension (e.g., a lock rod diameter). In the unlocked configuration, the first inner portion 700 can have the strained dimension, and the strained dimension can be greater than the lock rod dimension. In an example where the brake assembly 550 is in the unlocked configuration, a diameter of the first inner portion 700 is greater than a diameter of the lock rod 540. The first inner portion 700 is disengaged from the lock rod 540, thereby allowing the brake assembly 550 to translate with respect to the lock rod 540.

In the locked configuration, the first inner portion 700 can be engaged with the lock rod 540. As described in this disclosure, the engagement of the first inner portion 700 with the lock rod 540 can help prevent the translation of the brake assembly 550 with respect to the lock rod 540. The first inner portion 700 can have the relaxed dimension and the lock rod can have the lock rod dimension. The relaxed dimension can be less than or equal to the lock rod dimension. In the locked configuration, the first inner portion 700 can have the relaxed dimension, and the first inner portion 700 is engaged with (e.g., gripping, grabbing, grasping, constraining, constricting, or the like) the lock rod 540. The engagement of the first inner portion 700 with the lock rod 540 can help prevent the translation of the brake assembly 550 with respect to the lock rod 540. The relationship between the unlocked and locked configurations of the brake assembly 550, and the relaxed and strained state of the first torsion spring 610 can be interchanged (e.g., the first torsion spring 610 can be strained to engage the first inner portion 700 with the lock rod 540).

As shown in FIG. 7, the brake body 600 can define an aperture 750 in the brake body 600. The aperture 750 can be adapted to receive a tensile member (e.g., actuator cable 1440 of FIG. 14). A portion of the tensile member can be coupled with a portion of the first torsion spring 610, such as coupling an end of the tensile member with the first leg 710 of the first torsion spring 610.

A portion of the tensile member can be coupled with an actuator (e.g., a handle), such as coupling an end of the tensile member to the actuator 220 of FIG. 2. The actuator can manipulate the tensile member, such as by applying a force to (e.g., pull or push) the tensile member. The manipulation of the tensile member can displace the first leg 710 such that the dimension of the first inner portion 700 changes. The manipulation of the tensile member can help the first inner portion 700 to selectively engage with the lock rod 540. The manipulation of the tensile member can help prevent the translation of the brake assembly 550 with respect to the lock rod 540.

Referring again to FIG. 7, the brake assembly 550 can include a first adjustment clip 730. The first adjustment clip 730 can be adapted to change the dimension of the first inner portion 700. The first adjustment clip 730 can translate with respect to the brake body 600. The first adjustment clip 730 can engage with the first torsion spring 610, such as with a second leg 720 of first torsion spring 610, and thereby cause a change in the dimension of the first inner portion 700.

The brake assembly 550 can include a first adjustment fastener 740. The first adjustment fastener 740 can engage with a portion of the first adjustment clip 730. The first adjustment fastener 740 can engage with a portion of the brake body 600. Manipulation of the first adjustment fastener 740 can cause a corresponding translation of the first adjustment clip 730 with respect to the brake body 600. Manipulation of the first adjustment fastener 740 can cause a corresponding change in the dimension of the first inner portion 700. Manipulation of the first adjustment fastener 740 can help fine adjust (e.g., precisely establish) the dimension of the first inner portion 700. Fine adjusting of dimension of the first inner portion 700 with the first adjustment fastener 740 can correspondingly vary the amount of force necessary to change the dimension of the first inner portion 700 with the first leg 710 of the first torsion spring 610.

Figure 8:
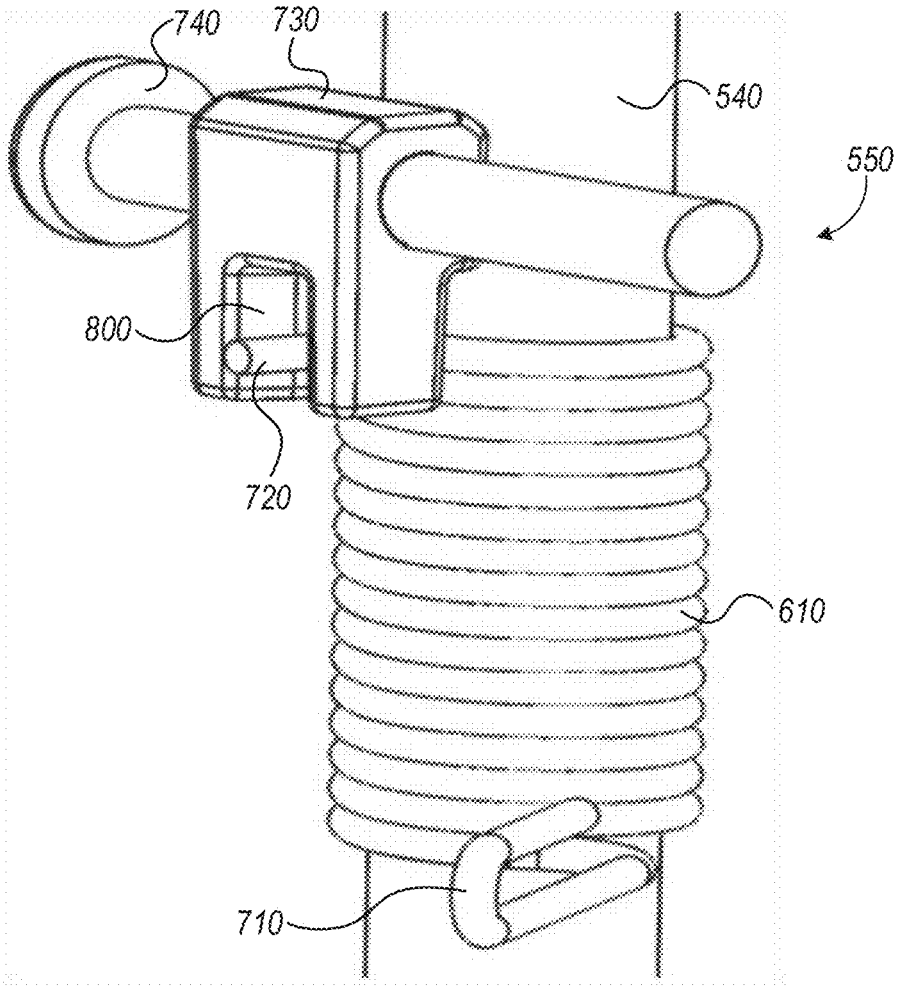
FIG. 8 is a perspective view of one example of a first adjustment clip for the brake assembly of FIG. 6.

FIG. 8 is a perspective view of one example of the first adjustment clip 730 for the brake assembly 550 of FIG. 6. Portions of the brake assembly 550 (e.g., the brake body 600, shown in FIGS. 6-7) have been removed for clarity. As described in this disclosure, the first adjustment fastener 740 can engage with a portion of the first adjustment clip 730. The first adjustment clip 730 can define a groove 800. The groove 800 can be sized and shaped to saddle the second leg 720 of the first torsion spring 610. Walls of the groove 800 can engage with the second leg 720 of the first torsion spring 610.

As described in this disclosure, the first adjustment clip 730 can translate with respect to the first adjustment fastener 740, and thereby cause translation of the first adjustment clip 730 with respect to the brake body 600 (shown in FIGS. 6-7). Manipulation of the first adjustment clip can help fine adjust the dimension of the first inner portion (shown in FIG. 7).

Figure 9:
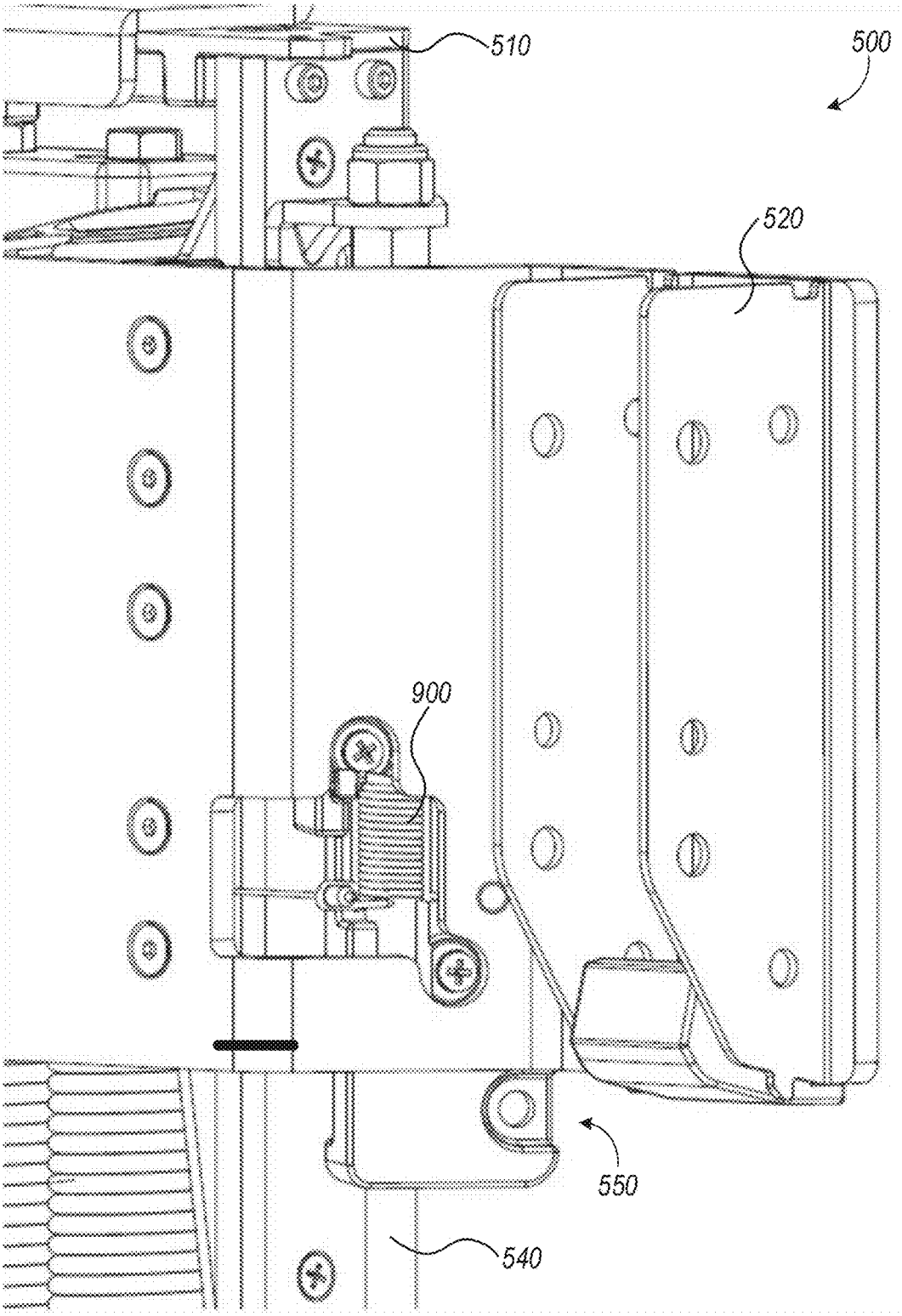
FIG. 9 is a perspective view of the riser of FIG. 5, including brake assembly of FIG. 6, with portions of the brake assembly hidden from view to expose internal components of the brake assembly.

FIG. 9 is a perspective view of the riser 500 of FIG. 5, including the brake assembly 550 of FIG. 6, with portions of the brake assembly 550 hidden from view to expose internal components of the brake assembly 550. The brake assembly 550 can include a second torsion spring 900. The second torsion spring 900 can help the brake assembly 550 selectively translate with respect to the lock rod 540. The second torsion spring 900 can be coupled with the counterbalance mechanism 530 (shown in FIGS. 5 and 11).

Figure 10:
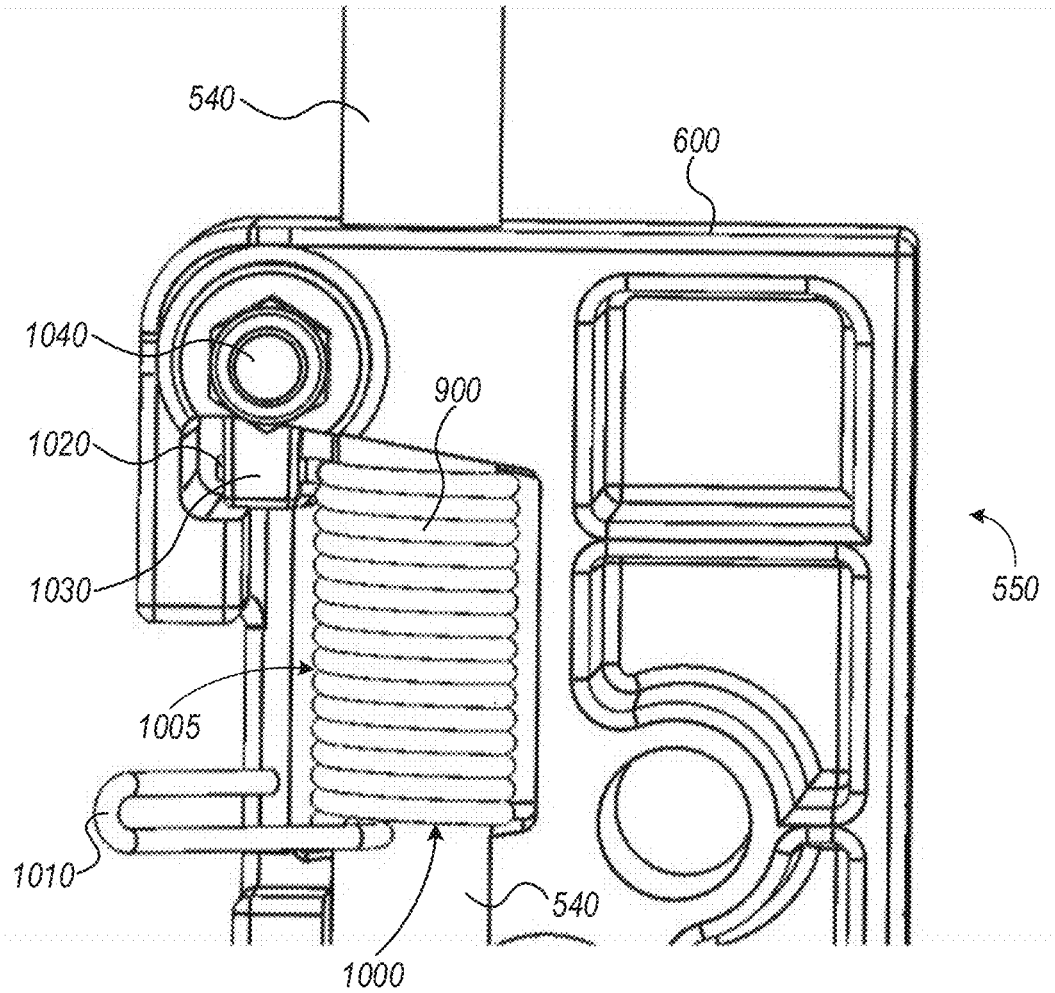
FIG. 10 is another perspective view of the brake assembly of FIG. 6, with portions of the brake assembly hidden from view to expose internal components of the brake assembly.

FIG. 10 is another perspective view of the brake assembly 550 of FIG. 6, with portions of the brake assembly 550 hidden from view to expose internal components of the brake assembly 550. The second torsion spring 900 a number of coils 1005 and a second inner portion 1000 that can be defined by an inner surface of the coils 1005. An outer surface of the coils 1005 of the second torsion spring 900 are shown in FIG. 10. The second inner portion 1000 can be sized and shaped to receive the lock rod 540.

The second torsion spring 900 can be adapted such that engagement with the second torsion spring 900 causes a dimension of the second inner portion 1000 to change. The second torsion spring 900 can include a first leg 1010 of the second torsion spring 900. The second torsion spring 900 can be biased such that the first leg 1010 is biased in a first direction with respect to the brake body 600. The second torsion spring 900 can be biased such that the first inner portion 1000 is engaged with (or disengaged from) the lock rod 540. Engagement (e.g., displacement or translation) with the first leg 1010 of the second torsion spring 900 can change the dimension of (e.g., expand the diameter of) the second inner portion 1000.

The second inner portion 1000 can have a relaxed state (e.g., there is no engagement with the second torsion spring 900) and a relaxed dimension (e.g., a first diameter) in the relaxed state. The first leg 1010 can be engaged with and thereby strain the second torsion spring 900. The engagement with the first leg 1010, and straining of the second torsion spring 900, can change the second inner portion 1000 to a strained dimension (e.g., a second diameter). The strained dimension can be greater than the relaxed dimension.

The second torsion spring 900 can be adapted such that the second inner portion 1000 selectively engages with the lock rod 540. Changing the dimension of the second inner portion 1000 can help the second inner portion 1000 to selectively engage with the lock rod 540. The engagement of the second inner portion 1000 with the lock rod 540 can help prevent (e.g., substantially inhibit, impede, or stop) the translation of the brake assembly 550 with respect to the lock rod 540.

The first torsion spring 610 and the second torsion spring 900 can be complementary. As described in further detail in this disclosure, the second inner portion 1000 can engage with the lock rod 540 irrespective of whether the first inner portion 700 (shown in FIG. 7) is engaged with the lock rod 540. The first torsion spring 610 (shown in FIGS. 6-8) and the second torsion spring 900 can be engaged independently such that the first inner portion 700 of the first torsion spring 610 can engage, and disengage, from the lock rod 540; regardless of whether the second inner portion 1000 is engaged, or disengaged, with the lock rod 540. Similarly, the first torsion spring 610 and the second torsion spring 900 can be engaged independently such that the second inner portion 1000 of the second torsion spring 900 can engage, and disengage, from the lock rod 540; regardless of whether the first inner portion 700 is engaged with the lock rod 540. Stated another way, the first torsion spring 610 and the second torsion spring 900 can be operated, or manipulated, independently of each other.

Referring again to FIG. 10, the brake assembly 550 can include a second adjustment clip 1030. The second adjustment clip 1030 can be adapted to change the dimension of the second inner portion 1000. The second adjustment clip 1030 can translate with respect to the brake body 600. The second adjustment clip 1030 can engage with the second torsion spring 900, such as with a second leg 1020 of second torsion spring 900, and thereby cause a change in the dimension of the second inner portion 1000.

The brake assembly 550 can include a second adjustment fastener 1040. The second adjustment fastener 1040 can engage with a portion of the second adjustment clip 1030. The second adjustment fastener 1040 can engage with a portion of the brake body 600. Manipulation of the second adjustment fastener 1040 can cause a corresponding translation of the second adjustment clip 1030 with respect to the brake body 600. Manipulation of the second adjustment fastener 1040 can cause a corresponding change in the dimension of the second inner portion 1000.

Manipulation of the second adjustment fastener 1040 can help fine adjust the dimension of the second inner portion 1000. Fine adjustment of the dimension of the second inner portion 1000 with the second adjustment fastener 1040 can correspondingly vary the amount of force necessary to change the dimension of the second inner portion 1000 with the first leg 1010 of the second torsion spring 900.

Figure 11:
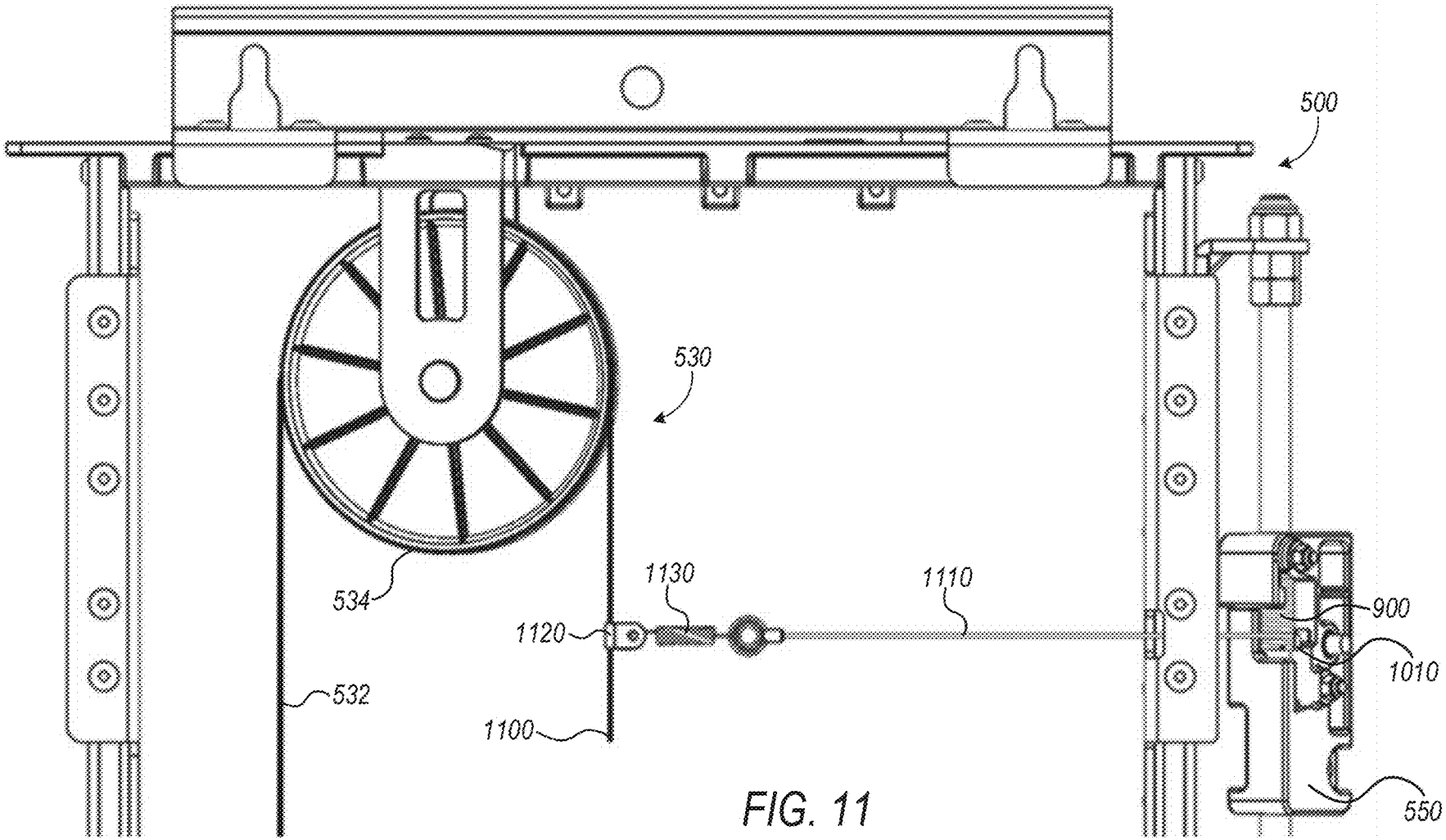
FIG. 11 is another perspective view of a portion of the riser of FIG. 5, including the brake assembly of FIG. 6.

FIG. 11 is another perspective view of a portion of the riser of FIG. 5, including the brake assembly of FIG. 6. For clarity, portions of the riser 500 and the brake assembly 550 have been hidden from view to expose internal components of the riser 500 and the brake assembly 550. As discussed in this disclosure, the riser 500 can include the counterbalance mechanism 530. The counterbalance mechanism 530 can include the wheel cable 532 and the pulley 534. The wheel cable 532 can include a cable end 1100. The cable end 1100 can be coupled to the sliding bracket 520 (shown in FIG. 5), and thereby couple the sliding bracket 520 with the counterbalance mechanism 530.

The riser 500 can include a tension cable 1110. The tension cable 1110 can couple the brake assembly 550 with the counterbalance mechanism 530, such as by coupling a hook 1120 to the counterbalance mechanism 530. The coupling of the tension cable 1110 can help supply tension to the brake assembly 550, such as by supplying tension to the first leg 1010 of the second torsion spring 900. A tension spring 1130 can be coupled between the tension cable 1110 and the counterbalance mechanism 530. The tension spring 1130 can help substantially equalize the tension supplied to the brake assembly 550 by the tension cable 1110.

As described in this disclosure, the tension cable 1110 can engage with a portion of the second torsion spring 900, such as the first leg 1010 of the second torsion spring 900. The tension cable 1110 can couple the first leg 1010 of the second torsion spring 900 with the counterbalance mechanism 530. The tension cable 1110 can help displace the first leg 1010 of the second torsion spring 900 such that the dimension of the second inner portion 1000 (shown in FIG. 10) of the second torsion spring 900 changes. The engagement of the tension cable 1110 with the first leg 1010 of the second torsion spring 900 can help selectively engage the second inner portion 1000 with the lock rod 540. The engagement of the tension cable 1110 with the first leg 1010 of the second torsion spring 900 can help prevent the translation of the brake assembly 550 with respect to the lock rod 540.

As described in this disclosure, the brake assembly 550 can include one or more configurations. The brake assembly 550 can include a safety configuration. In the safety configuration, the second inner portion 1000 can be engaged with the lock rod 540. The engagement of the second inner portion 1000 can help prevent the translation of the brake assembly 550 with respect to the lock rod 540.

As discussed in this disclosure, the second inner portion 1000 can have a relaxed dimension and a strained dimension. The lock rod 540 can have a lock rod dimension (e.g., a lock rod diameter). In the safety configuration, the second inner portion 1000 can have the relaxed dimension, and the second inner portion 1000 is engaged with (e.g., gripping, grabbing, grasping, constraining, constricting, or the like) the lock rod 540.

Referring again to FIG. 11, and as described in this disclosure, the tension cable 1110 can supply tension to brake assembly 550. The tension cable 1110 can help provide a consistent amount of tension to the brake assembly 550, and thereby help maintain the second inner portion 1000 (shown in FIG. 10) disengaged from the lock rod 540. Stated another way, the supply of tension to the brake assembly 550 can help prevent the brake assembly 550 from engaging the safety configuration.

As described in this disclosure, the riser 500 can include the counterbalance mechanism 530. During operation the wheel cable 532 is under tension. The tension cable 1110 can be coupled with the wheel cable 532. A loss of tension in the wheel cable 532 can cause a corresponding loss of tension in the tension cable 1110. The loss of tension in the tension cable 1110 can engage the safety configuration. The loss of tension in the tension cable 1110 can cause the second inner portion 1000 of the second torsion spring 900 to engage with the lock rod 540, and thereby prevent the translation of the brake assembly 550 with respect to the lock rod 540.

Figure 12:
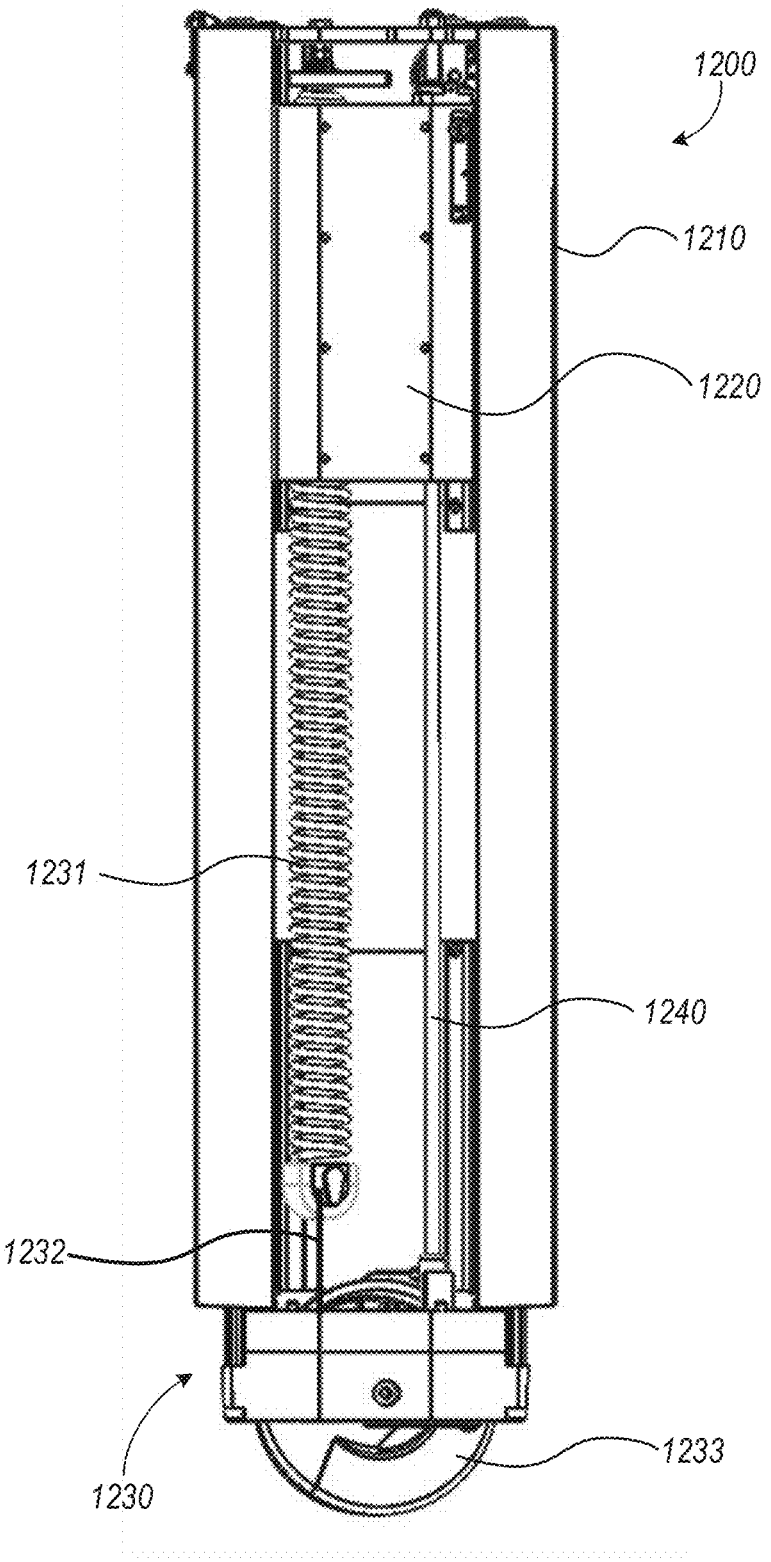
FIG. 12 is a front view of one example of a riser.

FIG. 12 is a front view of one example of a riser 1200 including a riser chassis 1210. The riser chassis 1210 can be adapted to house, and otherwise support, components of a height adjustable platform (e.g., the height adjustable platform 300 of FIG. 3).

The riser 1200 can include a sliding bracket 1220. The sliding bracket 1220 can be adapted to couple with, and thereby support, components of a height adjustable platform, such as the work surface 310 of FIG. 3. The sliding bracket 1220 can be moveably coupled with the riser chassis 1210 such that the sliding bracket 1220 is adapted to translate with respect to the riser chassis 1210. A portion of the sliding bracket 1220 can engage with a portion of the riser chassis 1210, and thereby moveably couple the sliding bracket 1220 with the riser chassis 1210. In an example, the riser chassis 1210 defines a keyway and the sliding bracket 1220 includes a key. The keyway can be sized and shaped to receive the key. The key can be sized and shaped to engage with the keyway. The engagement of the key with the keyway can help moveably couple the sliding bracket 1220 with the riser chassis 1210.

The riser 1200 can include a counterbalance mechanism 1230. The counterbalance mechanism 1230 can include one or more springs 1231, a wheel cable 1232, and can include a wheel/cam assembly 1233. The springs 1231, the wheel cable 1232, and the wheel/cam assembly 1233 can cooperate to help counterbalance a force applied to the sliding bracket 1220. Counterbalancing the force applied to the sliding bracket 1220 can help maintain the amount of force required to translate the sliding bracket 1220 with respect to the riser chassis 1210. Stated another way, the counterbalance mechanism 1230 can be adapted to support the sliding bracket 1220 such that the amount of force necessary to translate the sliding bracket 1220 with respect to the riser chassis 1210 remains substantially constant, despite a varying force generated by the one or more springs 1231. Additionally, the counterbalance mechanism 1230 can help maintain a position of the sliding bracket 1220 with respect to the riser chassis 1210.

Referring again to FIG. 12, and described in further detail in this disclosure, the riser 1200 can include a lock rod 1240. The lock rod 1240 can be coupled to the riser chassis 1210. Although the lock rod 1240 can be positioned internally within, or externally of, the riser chassis 1210, the specific configuration depicted in FIG. 12 depicts the lock rod 1240 positioned internally on a side of the riser chassis 1210. The lock rod 1240 can be spaced from the riser chassis 1210 at a first distance (e.g., a gap can exist between the lock rod 1240 and the riser chassis 1210). The lock rod 1240 can have a circular, square, rectangular, other geometric shape, or irregular cross-section (e.g., the lock rod 1240 can define a keyway).

Figure 13:
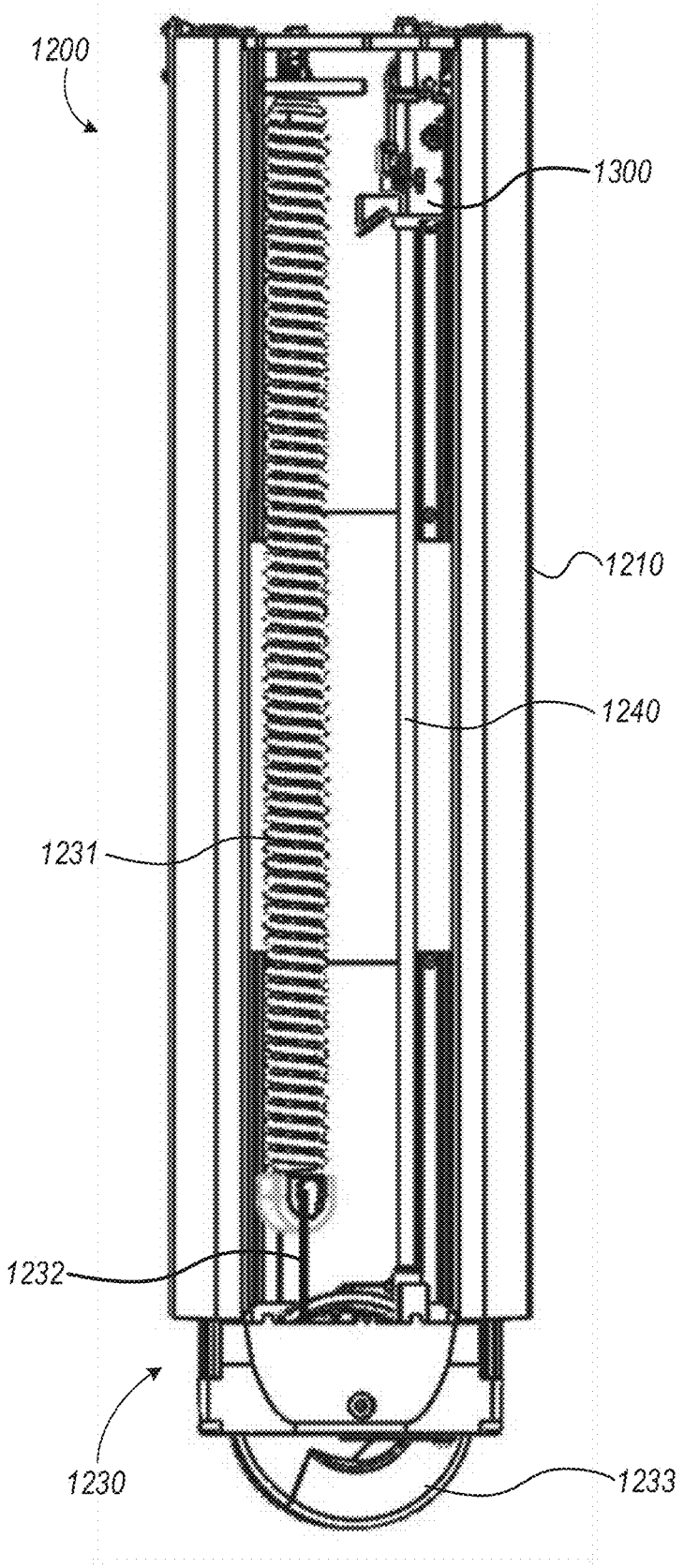
FIG. 13 is a front view of a portion of the riser of FIG. 12, including a brake assembly.

FIG. 13 is a front view of a portion of the riser 1200 of FIG. 12, including a brake assembly 1300. For clarity, the moving bracket 1220 has been hidden in FIG. 13 to expose internal components of the riser 1200. The brake assembly 1300 can be sized and shaped to receive the lock rod 1240. The brake assembly 1300 can be adapted to selectively translate with respect to (e.g., along) the lock rod 1240. The brake assembly 1300 can be coupled to, or included in, the sliding bracket 1220. The brake assembly 1300 can help maintain the position of the sliding bracket 1220 with respect to the riser chassis 1210. The brake assembly 1300 can be coupled to a work surface, such as the work surface 310 (shown in FIG. 3). The brake assembly 1300 can be adapted to couple with the work surface, such as indirectly with the sliding bracket 1220 or directly to the work surface. The brake assembly 1300 can help maintain the position of the work surface with respect to the riser 1200. In an example, the brake assembly 1300 can translate in a first direction (e.g., vertically) with respect to the lock rod 1240. The translation of the brake assembly 1300 in the first direction can correspondingly cause the work surface to translate in the first direction.

Figure 14:
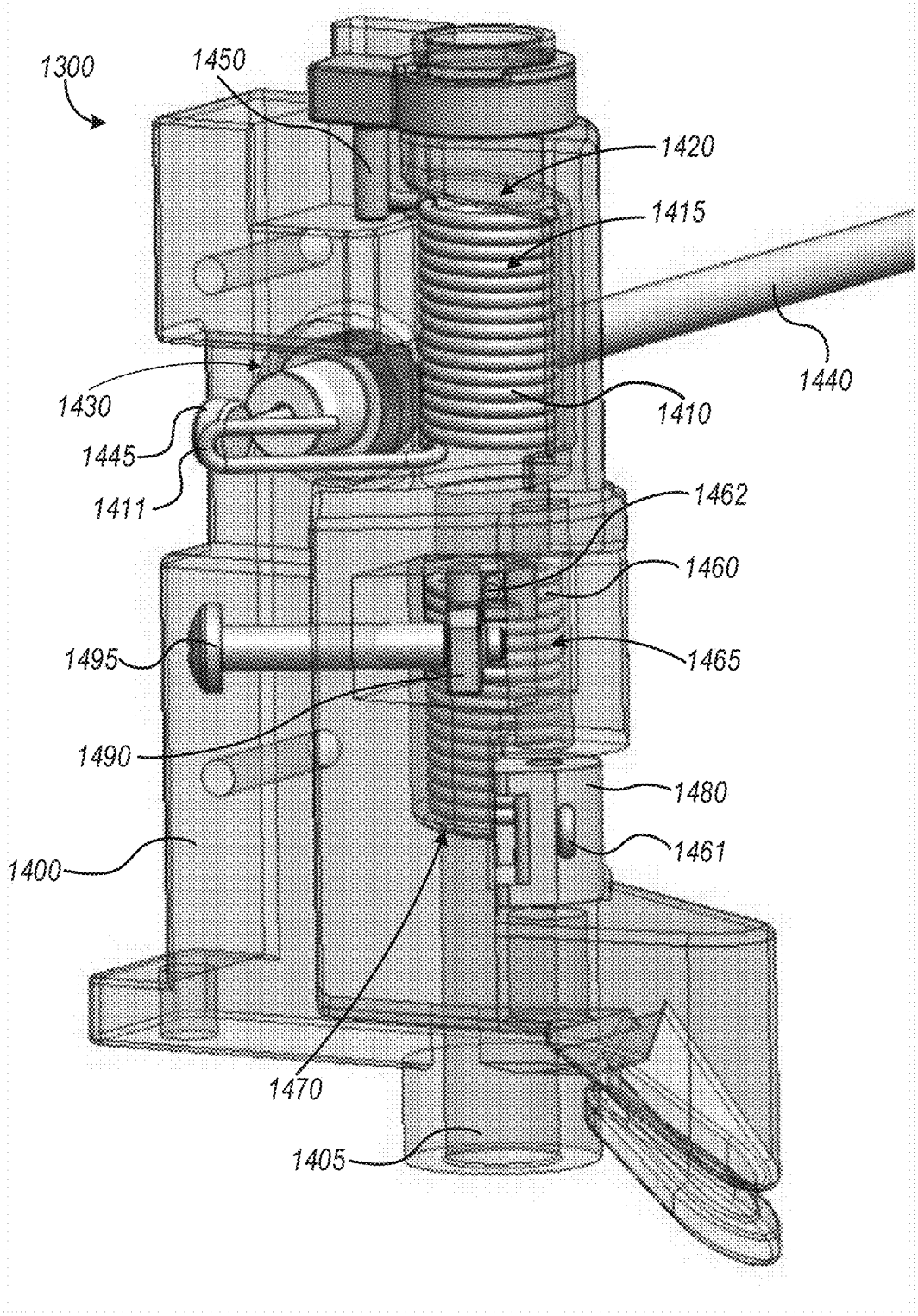
FIG. 14 is a perspective view of one example of the brake assembly of FIG. 13.

FIG. 14 is a perspective view of one example of the brake assembly 1300 of FIG. 13. The brake assembly 1300 can include a brake body 1400. For clarity, the brake body 1400 shown in FIG. 14 has been made transparent to show internal components of the brake assembly 1300. The brake body 1400 can be adapted to couple with the sliding bracket 1220 (e.g., the brake body is assembled to the sliding bracket 1220). The brake assembly 1300 can be sized and shaped to receive the lock rod 1240 (shown in FIGS. 12-13 and 15-16). The brake body 1400 can include a shaft 1405 adapted to receive the lock rod 1240. The brake body 1400 can be sized and shaped to receive the lock rod 1240. The brake assembly 1300 can selectively translate with respect to the lock rod 1240.

The brake assembly 1300 can include a first torsion spring 1410. The first torsion spring 1410 can help the brake assembly 1300 selectively translate with respect to the lock rod 1240. The first torsion spring 1410 can include a number of coils 1415 and a first inner portion 1420 that can be defined by an inner surface of the coils 1415. An outer surface of the coils 1415 of the first torsion spring 1410 are shown in FIG. 14.

The first inner portion 1420 can be sized and shaped to receive the lock rod 1240. The first torsion spring 1410 can be adapted such that engagement with the first torsion spring 1410 causes a dimension of the first inner portion 1420 to change. The first torsion spring 1410 can include a first leg 1411. As described further in this disclosure, engagement (e.g., displacement or translation) with the first leg 1411 of the first torsion spring 1410 can change the dimension of the first inner portion 1420. The first inner portion 1420 can have a relaxed state (e.g., there is no engagement with the first torsion spring 1410) and a relaxed dimension (e.g., a first diameter) in the relaxed state. The first leg 1411 can be engaged with and thereby strain the first torsion spring 1410. The engagement with the first leg 1411, and straining of the first torsion spring 1410, can change the first inner portion 1420 to a strained dimension (e.g., a second diameter). The strained dimension can be greater than the relaxed dimension.

The first torsion spring 1410 can be adapted such that the first inner portion 1420 selectively engages with the lock rod 1240. Changing the dimension of the first inner portion 1420 can help the first inner portion 1420 to selectively engage with the lock rod 1240. The engagement of the first inner portion 1420 with the lock rod 1240 can help prevent (e.g., substantially inhibit, impede, or stop) the translation of the brake assembly 1300 with respect to the lock rod 1240.

The brake assembly 1300 can include an unlocked configuration and a locked configuration. In the unlocked configuration, the first inner portion 1420 can be disengaged from the lock rod 1240, such as to allow the translation of the brake assembly 1300 with respect to the lock rod 1240. As discussed in this disclosure, the first inner portion 1420 can have a relaxed dimension and a strained dimension. The lock rod 1240 can have a lock rod dimension (e.g., a lock rod diameter). In the unlocked configuration, the first inner portion 1420 can have the strained dimension, and the strained dimension can be greater than the lock rod dimension. In an example where the brake assembly 1300 is in the unlocked configuration, a diameter of the first inner portion 1420 is greater than a diameter of the lock rod 1240. The first inner portion 1420 is disengaged from the lock rod 1240, thereby allowing the brake assembly 1300 to translate with respect to the lock rod 1240.

In the locked configuration, the first inner portion 1420 can be engaged with the lock rod 1240. As described in this disclosure, the engagement of the first inner portion 1420 with the lock rod 1240 can help prevent the translation of the brake assembly 1300 with respect to the lock rod 1240. The first inner portion 1420 can have the relaxed dimension and the strained dimension; and the lock rod can have the lock rod dimension. In the locked configuration, the first inner portion 1420 can have the relaxed dimension, and the first inner portion 1420 is engaged with (e.g., gripping, grabbing, grasping, constraining, constricting, or the like) the lock rod 1240. The engagement of the first inner portion 1420 with the lock rod 1240 can help prevent the translation of the brake assembly 1300 with respect to the lock rod 1240.

Referring again to FIG. 14, the brake body 1400 can define an aperture 1430 (also shown in FIG. 15) in the brake body 1400. The aperture 1430 can be adapted to receive a tensile member, such as an actuator cable 1440. A portion of the actuator cable 1440 can be coupled with a portion of the first torsion spring 1410, such as coupling an end of the actuator cable 1440 with the first leg 1411 of the first torsion spring 1410. The actuator cable 1440 can include a head 1445. The head 1445 of the actuator cable 1440 can engage with (e.g., displace or translate) the first leg 1411 of the first torsion spring 1410, and thereby change the dimension of the first inner portion 1420. An end of the actuator cable 1440 (e.g., an end opposite the head 1445) can be coupled with an actuator (e.g., a handle), such as the actuator 220 shown in FIG. 2. The actuator can cause the actuator cable (e.g., the head 1445) to engage with the first torsion spring 1410.

The brake assembly 1300 can include a first adjustment clip 1450. The first adjustment clip 1450 can be adapted to change the dimension of the first inner portion 1420. The first adjustment clip 1450 can translate with respect to the brake body 1400. The first adjustment clip 1450 can engage with the first torsion spring 1410, such as with a second leg of the first torsion spring 1410, and thereby cause a change in the dimension of the first inner portion 1420.

The brake assembly 1300 can include a first adjustment fastener. The first adjustment fastener can engage with a portion of the first adjustment clip 1450. The first adjustment fastener can engage with a portion of the brake body 1400. Manipulation of the first adjustment fastener can cause a corresponding translation of the first adjustment clip 1450 with respect to the brake body 1400.

Referring again to FIG. 14, the brake assembly 1300 can include a second torsion spring 1460. The second torsion spring 1460 can cooperate with the first torsion spring 1410 and can help prevent the translation of the brake assembly 1300 with respect to the lock rod 1240.

The second torsion spring 1460 can have a number of coils 1465 and a second inner portion 1470 that can be defined by an inner surface of the coils 1465. An outer surface of the coils 1465 of the second torsion spring 1460 are shown in FIG. 14. The second inner portion 1470 can be sized and shaped to receive the lock rod 1240 (shown in FIGS. 12-13 and 15-16).

The second torsion spring 1460 can be adapted such that engagement with the second torsion spring 1460 causes a dimension of the second inner portion 1470 to change. The second torsion spring 1460 can include a first leg 1461 of the second torsion spring 1460. As described further in this disclosure, engagement (e.g., displacement or translation) with the first leg 1461 of the second torsion spring 1460 can change the dimension of the second inner portion 1470.

The second torsion spring 1460 can help the brake assembly 1300 selectively translate with respect to the lock rod 1240 (shown in FIGS. 12-13 and 15-16). The second torsion spring 1460 can be coupled with the counterbalance mechanism 1230 (shown in FIGS. 12-13).

The brake assembly 1300 can include a tension clip 1480. The tension clip 1480 can be coupled with a portion of the counterbalance mechanism 1230. The tension clip 1480 can help facilitate the coupling of the first leg 1461 of the second torsion spring 1460 with the counterbalance mechanism 1230. The tension clip 1480 can define a clip passageway (e.g., the clip passageway 1600 of FIG. 16) in the tension clip 1480. The clip passageway can be sized and shaped to couple with a tensile member, such as the wheel cable 1232 shown in FIGS. 12-13 and 15-16).

Figure 15:
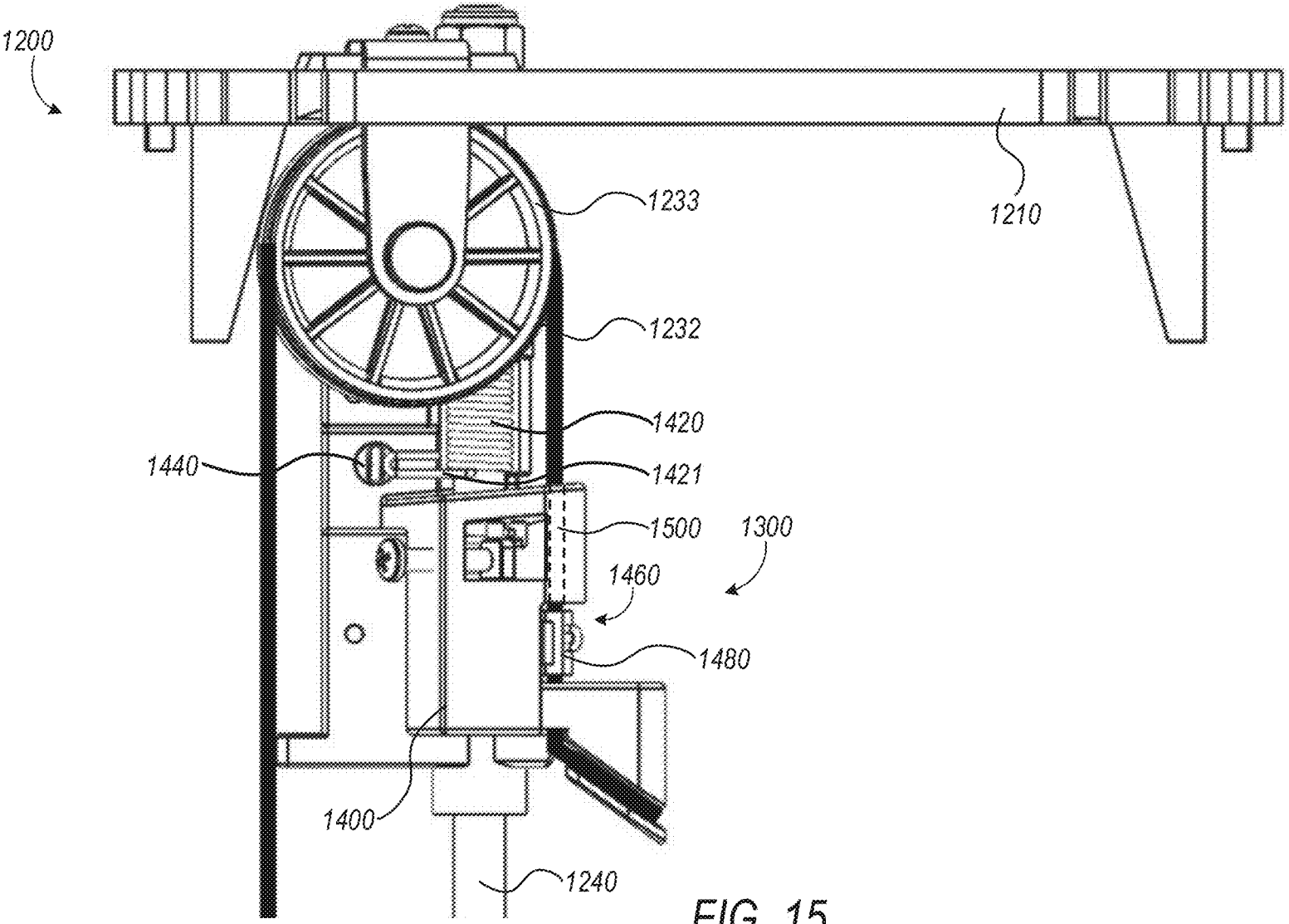
FIG. 15 is another perspective view of the riser and the brake assembly of FIG. 13.

The brake body 1400 can define a body passageway (e.g., the body passageway 1500 of FIG. 15). The body passageway can be sized and shaped to receive the tensile member. The body passageway and the clip passageway can be axially aligned. The first leg 1461 of the second torsion spring 1460 can be engaged such that the clip passageway is axially aligned with the body passageway. The second torsion spring 1460 can be biased such that the first leg 1461 is biased in a first direction with respect to (e.g., away from or toward) the brake body 1400. The biasing of the first leg 1461 in the first direction the brake body 1400 can correspondingly bias the clip passageway out of axial alignment with the body passageway. The biasing of the first leg 1461 in the first direction can engage the second inner portion 1470 of the second torsion spring 1460 with lock rod 1240 (shown in FIGS. 12-13 and 15-16). Engagement with the first leg 1461 can overcome the bias, and axially align the clip passageway with the body passageway.

Referring again to FIG. 14, the brake assembly 1300 can include a second adjustment clip 1490. The second adjustment clip 1490 can be adapted to change the dimension of the second inner portion 1470. The second adjustment clip 1490 can translate with respect to the brake body 1400. The second adjustment clip 1490 can engage with the second torsion spring 1460 and change the dimension of the second inner portion 1470. The second adjustment clip 1490 can engage (e.g., displace or translate) a second leg 1462 of the second torsion spring 1460 and can thereby change the dimension of the second inner portion 1470.

The brake assembly 1300 can include a second adjustment fastener 1495. The second adjustment fastener 1495 can engage with a portion of the second adjustment clip 1490. The second adjustment fastener 1495 can engage with a portion of the brake body 1400. Manipulation of the second adjustment fastener 1495 can cause a corresponding translation of the second adjustment clip 1490 with respect to the brake body 1400. Manipulation of the second adjustment fastener 1495 can cause a corresponding change in the dimension of the second inner portion 1470.

FIG. 15 is another perspective view of the riser and the brake assembly of FIG. 13. The brake assembly 1300 can be located proximate the counterbalance mechanism 1230. The brake assembly 1300 can define a body passageway 1500. The body passageway can be sized and shaped to receive a tensile member, such as the wheel cable 1232. The tensile member can pass through the body passageway and couple with the tension clip 1480. A supply of tension to the wheel cable 1232 can supply tension to the brake assembly 1300. The supply of tension to the wheel cable 1232 can supply tension to the second torsion spring 1260. The supply of tension to the second torsion spring 1260 can axially align a clip passageway (e.g., the clip passageway 1600 of FIG. 16) of the tension clip 1480 with the body passageway 1500. As the brake assembly 1300 translates with respect to the lock rod 1240, the wheel cable 1232 can correspondingly translate (e.g., lengthen) with respect to the lock rod 1240.

As described in this disclosure, the brake assembly 1300 can include an unlocked configuration and a locked configuration. In the unlocked configuration, the first inner portion 1420 can be disengaged from the lock rod 1240, such as to allow the translation of the brake assembly 1300 with respect to the lock rod 1240. In the locked configuration, the first inner portion 1420 can be engaged with the lock rod 1240. The engagement of the first inner portion 1420 with the lock rod 1240 can help prevent the translation of the brake assembly 1300 with respect to the lock rod 1240.

As described in this disclosure, the brake assembly 1300 can include a safety configuration. In the safety configuration, the second inner portion 1470 (shown in FIG. 14) can be engaged with the lock rod 1240. The engagement of the second inner portion 1470 can help prevent the translation of the brake assembly 1300 with respect to the lock rod 1240.

As described in this disclosure, the riser 1200 can include a wheel cable 1232. The wheel cable 1232 can couple the brake assembly 1300 with the counterbalance mechanism 1230. The wheel cable 1232 can couple with the tension clip 1480, and can thereby couple the first leg 1461 of the second torsion spring 1460 with the counterbalance mechanism 1230. The coupling of the wheel cable 1232 to the brake assembly 1300 can help supply tension to the brake assembly 1300, such as by supplying tension to the first leg 1461 of the second torsion spring 1460. The wheel cable 1232 can help provide a consistent amount of tension to the brake assembly 1300, and thereby help maintain the second inner portion 1470 (shown in FIG. 14) disengaged from the lock rod 1240. Stated another way, the supply of tension to the brake assembly 1300 can help prevent the brake assembly 1300 from engaging the safety configuration.

A loss of tension in the wheel cable 1232 can engage the safety configuration. The loss of tension in the wheel cable 1262 can cause a corresponding loss of tension supplied to the brake assembly 1300. The loss of tension in the wheel cable 1232 can cause a corresponding loss of tension supplied to the tension clip 1480. The loss of tension supplied to the tension clip 1480 can cause the first leg 1461 of the second torsion spring 1460 to be biased with respect to the brake body 1400 (e.g., in the first direction, such as away from the brake body 1400). As described in this disclosure, the biasing of the first leg 1461 can engage the second inner portion 1470 (shown in FIG. 14) with the lock rod 1240, and thereby help prevent the translation of the brake assembly 1300 with respect to the lock rod 1240.

Figure 16:
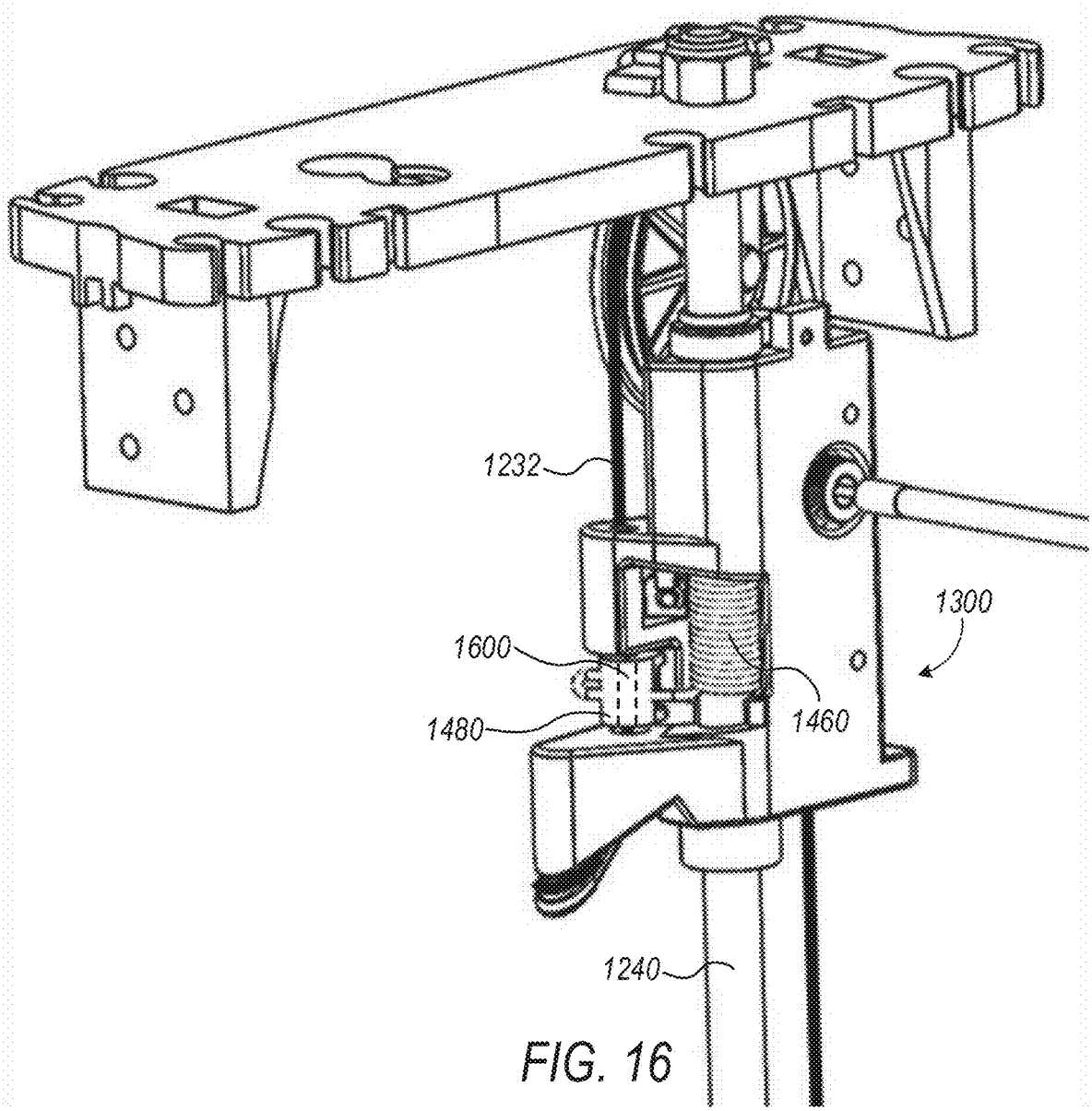
FIG. 16 is yet another perspective view of the riser and the brake assembly of FIG. 13.

FIG. 16 is yet another perspective view of the riser and the brake assembly of FIG. 13. The brake assembly 1300 can include a clip passageway 1600. The tension clip 1480 can define the clip passageway 1600. The clip passageway 1600 can be sized and shaped (or otherwise adapted) to couple with a tensile member, such as the wheel cable 1232 shown in FIGS. 12-13 and 15-16).

As described in this disclosure, the first leg 1461 (shown in FIG. 14) of the second torsion spring 1460 can be biased with respect to the brake body 1400. Tension supplied by the wheel cable 1232 can overcome the bias of the first leg 1461. A loss of tension in the wheel cable 1232 can cause a corresponding loss of tension supplied to the second torsion spring 1460. The loss of tension to the second torsion spring 1260 can bias the first leg 1461 with respect to the brake body 1400 (e.g., away from the brake body 1400). The biasing of the first leg 1461 can correspondingly bring the clip passageway 1600 out of axial alignment with a body passageway (e.g., the body passageway 1500 of FIG. 15). The biasing of the first leg 1461 can engage the second inner portion 1470 (shown in FIG. 14) with the lock rod 1240, and can thereby prevent the translation of the brake assembly 1300 with respect to the lock rod 1240.

Figure 17:
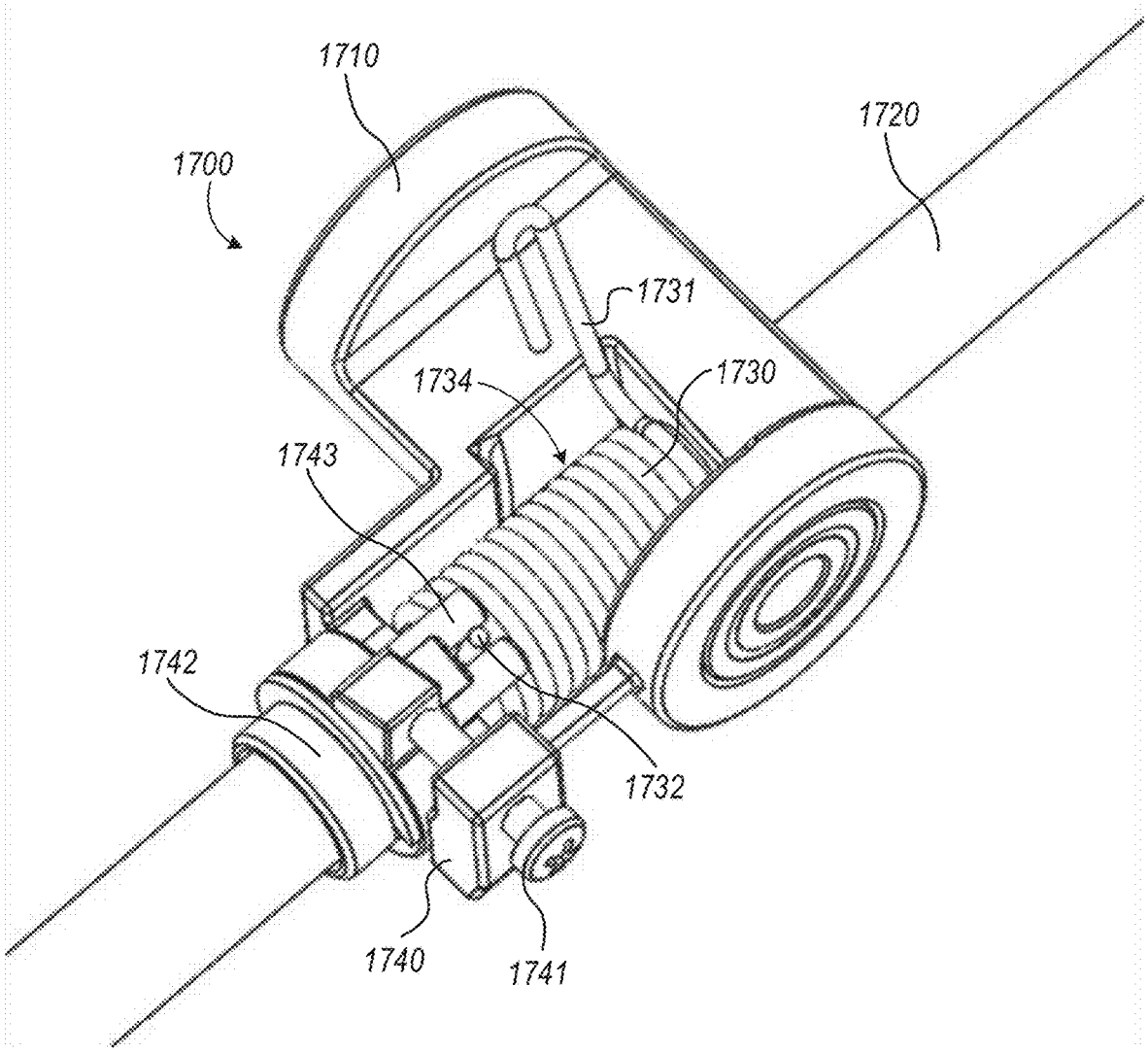
FIG. 17 is a perspective view of one example of a portion of a brake assembly.

FIG. 17 is a perspective view of one example of a portion of a brake assembly 1700. The brake assembly 1700 can include a brake body 1710. The brake body 1710 can be sized and shaped to receive a lock rod 1720. The brake assembly 1700 can translate with respect to the lock rod 1720.

The brake assembly 1700 can include a torsion spring 1730. The torsion spring 1730 can include a first leg 1731 and a second leg 1732. The torsion spring 1730 can help the brake assembly 1700 selectively translate with respect to the lock rod 1720. The torsion spring 1730 can include a number of coils 1734 and an inner portion that can be defined by an inner surface of the coils 1734. An outer surface of the coils 1734 of the torsion spring 1730 are shown in FIG. 17. The inner portion of the torsion spring 1730 can be sized and shaped to receive the lock rod 1720. The torsion spring 1730 can be adapted such that engagement with the torsion spring 1730 causes a dimension (e.g., a diameter) of the inner portion to change.

Engagement (e.g., displacement or translation) with the first leg 1731 of the torsion spring 1730 can change the dimension of the inner portion of the torsion spring 1730.

The inner portion can have a relaxed state (e.g., there is no engagement with the torsion spring 1730) and a relaxed dimension (e.g., a first diameter) in the relaxed state. The first leg 1731 can be engaged with, and can thereby strain, the torsion spring 1730. The engagement with the first leg 1731, and straining of the torsion spring 1730, can change the inner portion of the torsion spring 1730 to a strained dimension (e.g., a second diameter). The strained dimension can be greater than the relaxed dimension. The torsion spring 1730 can be biased such that the inner portion of the torsion spring 1730 is engaged with the lock rod 1720 (e.g., in the relaxed state).

The brake assembly 1700 can include an unlocked configuration and a locked configuration. In the unlocked configuration, the inner portion of the torsion spring 1730 can be disengaged from the lock rod 1720, such as to allow the translation of the brake assembly 1700 with respect to the lock rod 1720. As discussed in this disclosure, the inner portion can have a relaxed dimension and a strained dimension. The lock rod 1720 can have a lock rod dimension (e.g., a lock rod diameter). In the unlocked configuration, the inner portion of the torsion spring 1730 can have the strained dimension, and the strained dimension can be greater than the lock rod dimension. In an example where the brake assembly 1700 is in the unlocked configuration, a diameter of the inner portion is greater than a diameter of the lock rod 1720. The inner portion is disengaged from the lock rod 1720, thereby allowing the brake assembly 1700 to translate with respect to the lock rod 1720.

In the locked configuration, the inner portion of the torsion spring 1730 can be engaged with the lock rod 1720. The engagement of the inner portion with the lock rod 1720 can help prevent the translation of the brake assembly 1700 with respect to the lock rod 1720. In the locked configuration, the inner portion of the torsion spring 1730 can have the relaxed dimension, and the lock rod 1720 can have the lock rod dimension. The relaxed dimension can be less than or equal to the lock rod dimension.

In the locked configuration, the inner portion of the torsion spring 1730 can have the relaxed dimension, and the inner portion can be engaged with (e.g., gripping, grabbing, grasping, constraining, constricting, or the like) the lock rod 1720. The engagement of the inner portion with the lock rod 1720 can help prevent the translation of the brake assembly 1700 with respect to the lock rod 540. The relationship between the unlocked and locked configurations of the brake assembly 550, and the relaxed and strained state of the first torsion spring 610 can be interchanged.

The brake assembly 1700 can include an adjustment assembly 1740. The adjustment assembly 1740 can include an adjustor body 1741. The adjustor body 1741 can be coupled with the brake body 1710. The adjustor body 1741 can be sized and shaped to receive an adjustment fastener 1742. The adjustment fastener 1742 can engage with (e.g., a threaded engagement with) a portion of the adjustor body 1741.

The adjustment assembly 1740 can include a collar 1743. The collar 1743 can be adapted to displace the second leg 1732 of the torsion spring 1730. The collar 1743 can be displaced with respect to (e.g., rotate about) the lock rod 1720. The adjustment fastener 1742 can engage with a portion of the collar 1743, and can thereby displace the collar 1743 with respect to the lock rod 1720. The collar 1743 can include one or more protrusions 1744. The protrusions 1744 can be sized and shaped to saddle the second leg 1732 of the torsion spring 1730. Walls of the protrusions 1744 can engage with the second leg 1732 of the torsion spring 1730. Manipulation of the adjustment assembly 1740 can help fine adjust the dimension of the inner portion of the torsion spring 1730.

Figure 18:
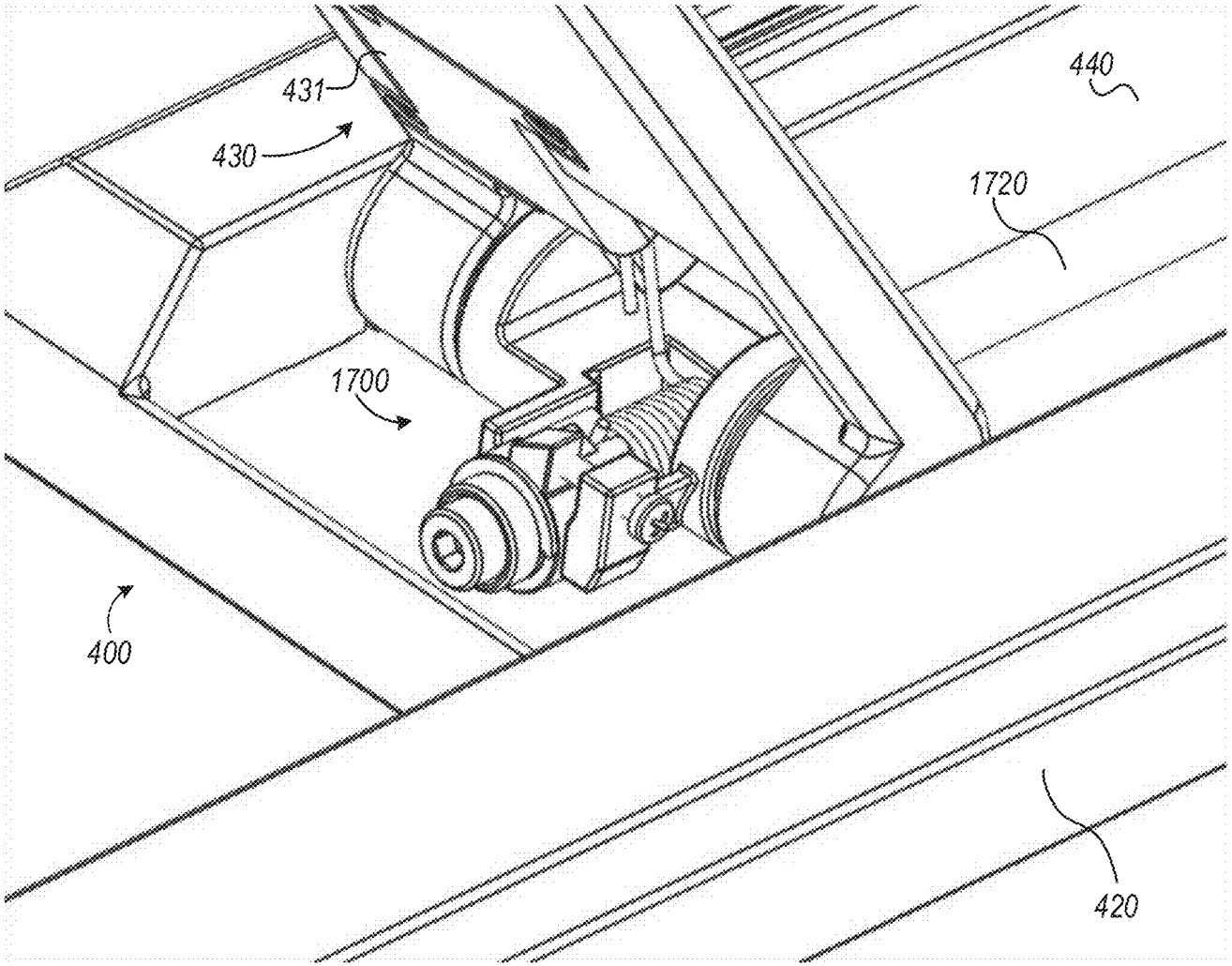
FIG. 18 is another perspective view of the brake assembly of FIG. 17.

FIG. 18 is another perspective view of the brake assembly of FIG. 17. The brake assembly 1700 can be coupled to a leg assembly (e.g., the leg assembly 430, also shown in FIG. 4). The brake assembly 1700 can be coupled to the first leg 431 of the leg assembly 430. The brake assembly 1700 can be rotatably coupled with the first leg 431. For example, the first leg 431 can be coupled to the brake assembly 1700 at a hinge, and the first leg 431 can rotate about the hinge. Rotation of the leg with respect to the brake assembly 1700 can cause a corresponding change in overall height of the leg assembly 430 (and can thereby change a height of components coupled to the leg assembly 430, such as the work surface 410 shown in FIG. 4).

The lock rod 1720 can be coupled to a portion of a height adjustable work surface, such as the height adjustable work platform 400 (shown in FIG. 4). The lock rod 1720 can be positioned within a foot assembly (e.g., the foot assembly 420, also shown in FIG. 4). As described in this disclosure, the foot assembly 420 can include a track 440. The lock rod 1720 can be positioned within the track 440. The lock rod 1720 can extend along a longitudinal axis of the track 440.

The brake assembly 1300 can help maintain the position of the leg assembly 430 with respect to the foot assembly 420, such as by engaging with the lock rod 1720. The brake assembly 1700 can translate with respect to the lock rod 1720. The translation of the brake assembly 1700 with respect to the lock rod 1720 can correspondingly change the overall height of the leg assembly 430 (also shown in FIG. 4). For example, as the brake assembly 1700 translate along a length of the lock rod 1720, the first leg 431 can rotate about the brake assembly 1700. The rotation of the first leg about the brake assembly 1700 can correspondingly lower the work surface from an initial position. In an example, the brake assembly 1300 can translate in a first direction (e.g., horizontally) along the lock rod 1240. The translation of the brake assembly 1300 in the first direction can correspondingly cause the work surface (e.g., the work surface 410 of FIG. 4) to translate in a second direction (e.g., vertically). The first direction can be different than (e.g., perpendicular to) the second direction.

Figure 19:
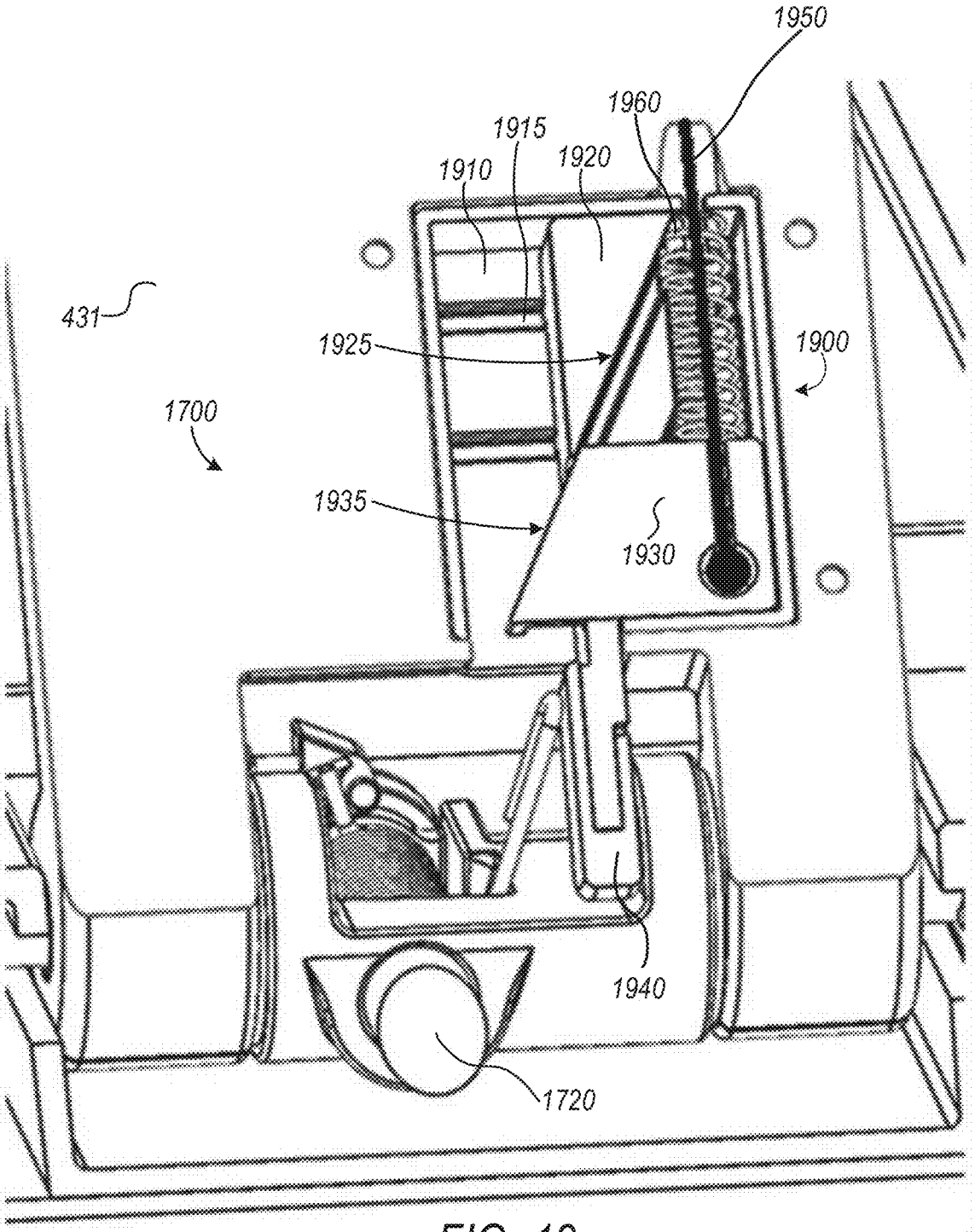
FIG. 19 is yet another perspective view of the brake assembly of FIG. 17.

FIG. 19 is yet another perspective view of the brake assembly of FIG. 17. As described in this disclosure, the torsion spring 1730 can be adapted such that engagement with the torsion spring 1730 causes a dimension (e.g., a diameter) of the inner portion to change. Engagement (e.g., displacement or translation) with the first leg 1731 of the torsion spring 1730 can change the dimension of the inner portion of the torsion spring 1730.

A height adjustable platform, such as the height adjustable platform 400, can include an actuator assembly 1900. The actuator assembly 1900 can be adapted to engage with the torsion spring 1730. The actuator assembly 1900 can engage with the first leg 1731 of the torsion spring 1730, and can thereby change the dimension of the inner portion of the torsion spring 1730. The actuator assembly 1900 can include an actuation pad 1940. The actuation pad 1940 can be adapted to engage with the first leg 1731 of the torsion spring 1730. The actuator assembly 1900 can cause the inner portion of the torsion spring 1730 to change, and thereby allow the brake assembly 1700 to translate with respect to the lock rod 1720.

The actuator assembly 1900 can be coupled to, or included in, the leg assembly 430 (e.g, the first leg 431). The actuator assembly 1900 can include an actuator body 1910.

The leg assembly 430 can define the actuator body 1910. As discussed further in this disclosure, the actuator body 1910 can define one or more grooves 1915 in the actuator body 1910.

The actuator assembly 1900 can include a first sliding bracket 1920. The grooves 1915 can be sized and shaped to receive the first sliding bracket 1920. The first sliding bracket 1920 can be in a slidable engagement with the grooves 1915. The first sliding bracket 1920 can translate with respect to the actuator body 1910. The first sliding bracket 1920 can translate from a first position in the actuator body 1910, to a second position in the actuator body 1910.

The actuator assembly 1900 can include a second sliding bracket 1930. The grooves 1915 can be sized and shaped to receive the second sliding bracket 1930. The second sliding bracket 1930 can be in a slidable engagement with the grooves 1915. The second sliding bracket 1930 can translate with respect to the actuator body 1910. The second sliding bracket 1930 can translate from a first position in the actuator body 1910, to a second position in the actuator body 1910.

The first sliding bracket 1920 can include a first angled surface 1925. The second sliding bracket 1930 can include a second angled surface 1935. The first angled surface 1925 can slidably engage with the second angled surface 1935. The slidable engagement of the first angled surface 1925 with the second angled surface 1935 can interlink the first sliding bracket 1920 with the second sliding bracket 1930 such that the translation of the second sliding bracket 1930 causes a corresponding translation of the first sliding bracket 1920.

The actuator assembly 1900 can include an actuator cable 1950. The actuator cable 1950 can be adapted to couple with a portion of the actuator assembly 1900, such as the second sliding bracket 1930. The actuator cable 1950 can displace, and thereby translate, the second sliding bracket 1930. A compression spring 1960 can bias the second sliding bracket 1930 toward the first position in the actuator body 1910. Similarly, the compression spring 1960 can maintain tension in the actuator cable 1950.

A user can engage with an actuator (e.g., the actuator 220 of FIG. 2) and can cause the second sliding bracket 1930 to translate within the actuator body 1910, such as from the first position to the second position. Because the first sliding bracket 1920 and the second sliding bracket 1930 are in slidable engagement with each other, the translation of the second sliding bracket 1930 can correspondingly translate the first sliding bracket 1920. The translation of the second sliding bracket 1930 from the first position to the second position can correspondingly cause the first sliding bracket 1920 to translate from the first position to the second position. In an example, the second sliding bracket 1930 can translate in a first direction (e.g., vertically). The first sliding bracket 1920 can translate in a second direction (e.g., horizontally). The first direction can be angled with respect to the second direction (e.g., by 90 degrees). Translation of the second sliding bracket 1930 in the first direction can cause the first sliding bracket 1920 to translate in the second direction.

The actuator pad 1940 can be coupled with the second sliding bracket 1930. Translation of the second sliding bracket 1930 can correspondingly cause a translation of the actuator pad 1940. As described in this disclosure, the actuator pad 1940 can engage with the first leg 1731 of the torsion spring 1730. The first leg 1731 can be biased against the actuator pad 1940.

Referring again to FIG. 19, a user can engage with an actuator (e.g., the actuator 220 of FIG. 2) and can cause the second sliding bracket 1930 to translate within the actuator body 1910. The translation of the second sliding bracket 1930 can correspondingly translate the actuator pad 1940, because the second sliding bracket 1930 can displace the first sliding bracket 1920. The engagement of the actuator pad 1940 with the torsion spring 1730 can change the dimension of the inner portion of the torsion spring 1730, and can thereby cause the inner portion of the torsion spring 1730 to disengage from the lock rod 1720. The engagement of the actuator pad 1940 with the torsion spring 1730 can allow the brake assembly 1700 to translate with respect to the lock rod 1720.

Figure 20:
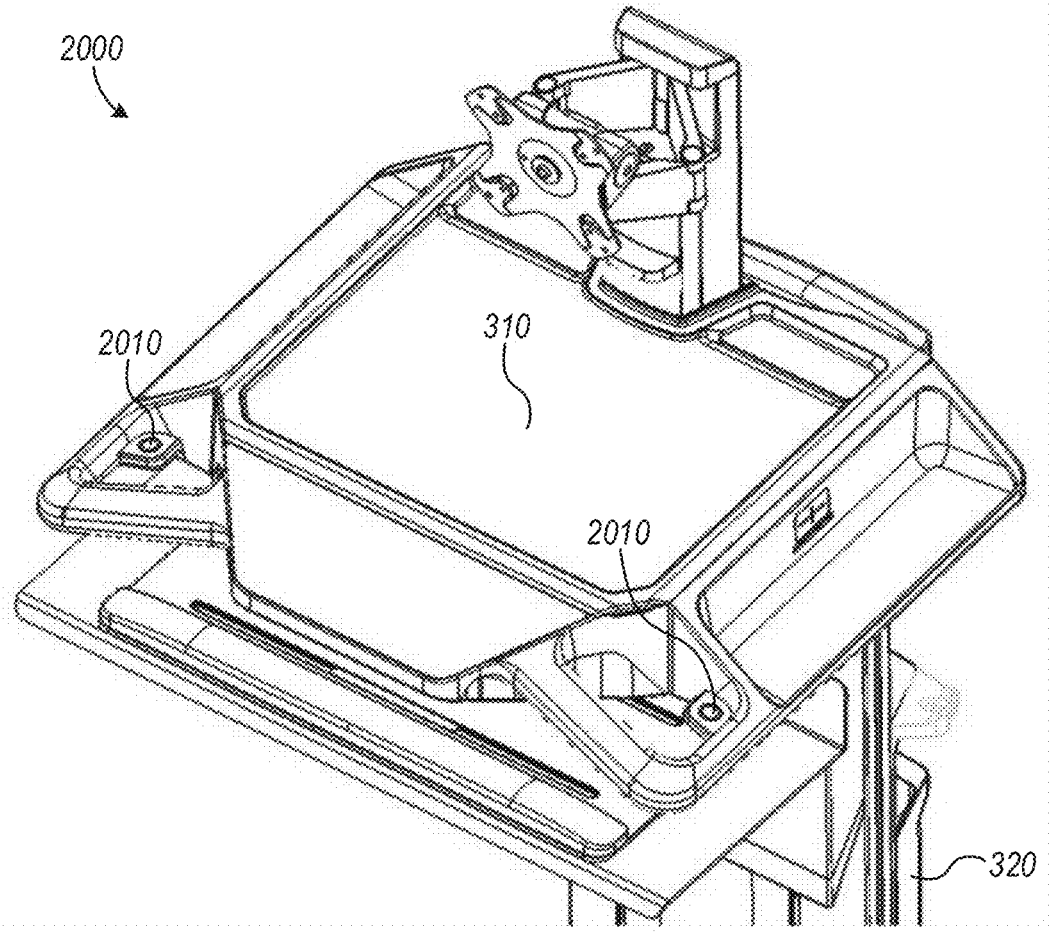
FIG. 20 is a perspective view of still yet another example of a height adjustable platform.

FIG. 20 is a perspective view of still yet another example of a height adjustable platform 2000. The height adjustable platform 2000 can be similar to the height adjustable platform 300 shown in FIG. 3. For instance, the height adjustable platform 2000 can include a work surface 310 and can include a riser 320. The work surface 310 can be coupled with the riser 320 such that the work surface 310 is able to translate with respect to the riser 320 (or translate with respect to portions of the riser 320, for instance the riser chassis 1210 shown in FIG. 12). As described in this disclosure, the height adjustable platform 300 can include a brake assembly (e.g., the brake assembly 2100 shown in FIGS. 21-22). The brake assembly can help prevent the translation of the work surface 310 with respect to the riser 320.

In some examples, the height adjustable platform 2000 can include a switch 2010. Optionally, the switch 2010 can be located proximate to the work surface 310. Engagement with the switch 2010 (e.g., by a user pushing a button) can facilitate translation of the work surface 310. For instance, engagement with the switch 2010 can allow a user to raise or lower the work surface 310.

Figure 21:
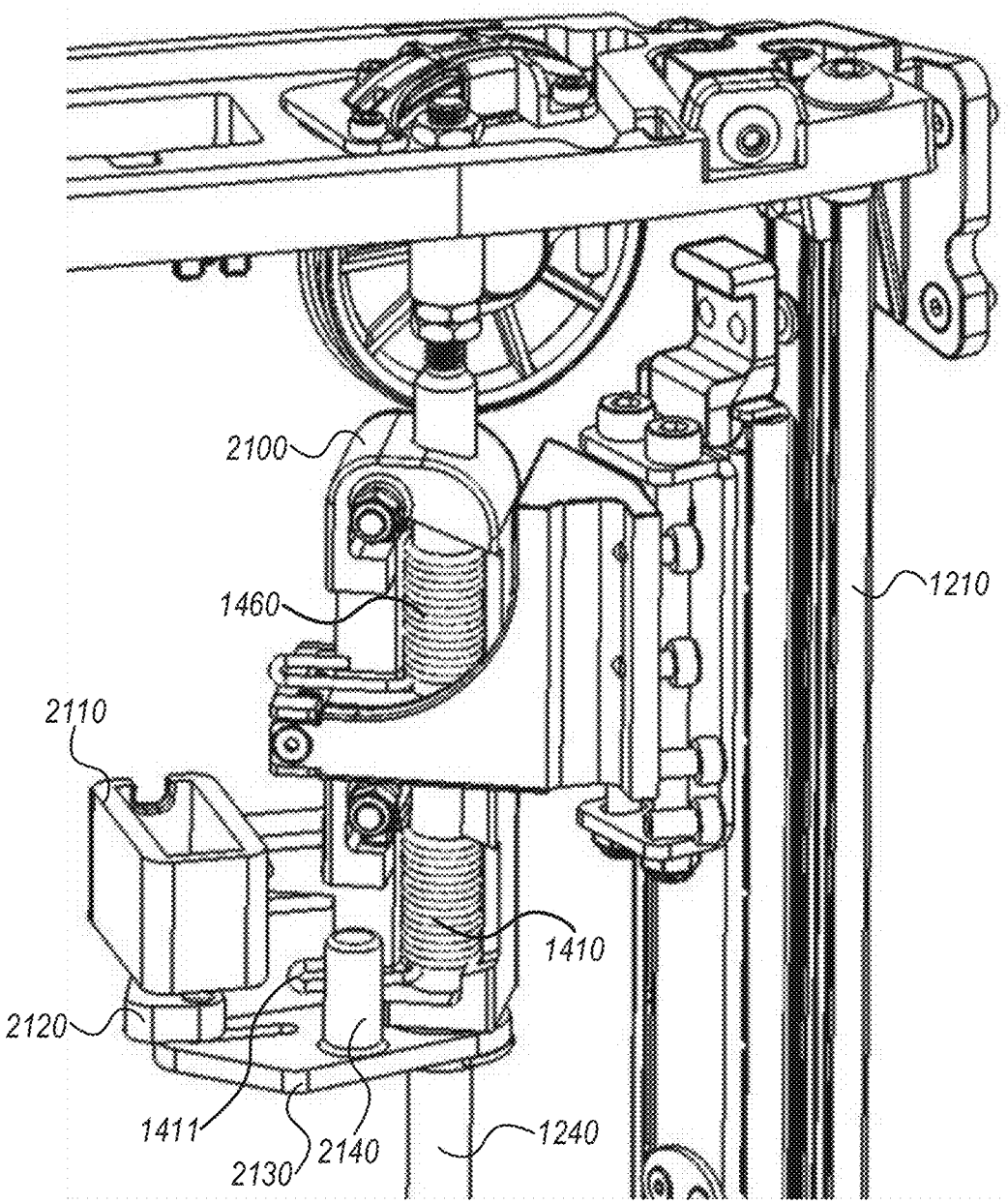
FIG. 21 is a perspective view of another example of a brake assembly.

FIG. 21 is a perspective view of another example of a brake assembly 2100. Some of the components of the brake assembly 2100 can be similar to components of the brake assembly 1300 shown in FIG. 13. For instance, the brake assembly 2100 can include the brake body 1400 and the first torsion spring 1410. The brake body 1400 can be sized and shaped to receive the lock rod 1240. Additionally, the brake assembly 1300 can selectively translate with respect to the lock rod 1240. For instance, the first torsion spring 1410 can help the brake assembly 1300 selectively translate with respect to the lock rod 1240 (e.g., the first inner portion 1420 of the spring 1410, shown in FIG. 14, can selectively engage with the lock rod 1240). The brake assembly 2100 can include the unlocked configuration (e.g., the spring 1410 is disengaged from the lock rod 1240) and the locked configuration (e.g., the spring 1410 is engaged with the lock rod 1240).

The brake assembly 2100 can include a servo drive 2110 that is optionally coupled with the brake body 1400. The servo drive 2110 can be one example of an actuator for the brake assembly 2100. The servo drive 2110 can be in electrical communication with the switch 2010, and engagement with the switch 2010 (e.g., by a user pressing a button) can activate the servo drive 2110 (e.g., activate an electrical motor) to change the configuration of the brake assembly 2100 between the locked configuration and the unlocked configuration. For instance, activation of the servo drive 2110 can displace the drive arm 2120 between a first position and a second position. The drive arm 2120 can be engaged with a control arm 2130, and displacement of the drive arm 2120 can correspondingly displace the control arm 2130.

In an example, the control arm 2130 can be displaced (including, but not limited to, pivoting about the lock rod 1240) and engage with the spring 1410. The engagement of the control arm 2130 with the spring 1410 can disengage the spring 1410 from the lock rod 1240. For instance, the displacement of the control arm 2130 can engage a spring boss 2140 with the first leg 1411 of the spring 1410 to overcome the bias of the spring 1410 and open the spring 1410. Opening the spring 1410 can disengage the spring 1410 from the lock rod 1240.

In another example, the displacement of the control arm 2130 can engage the spring 1410 with the lock rod 1240. For instance, the control arm 2130 can be displaced and allow the spring 1410 to close. In some examples, the spring 1410 can be biased toward engagement with the lock rod 1240 and displacement of the control arm 2130 can facilitate engaging the spring 1410 with the lock rod 1240 (e.g., by relaxing the spring 1410).

Figure 22:
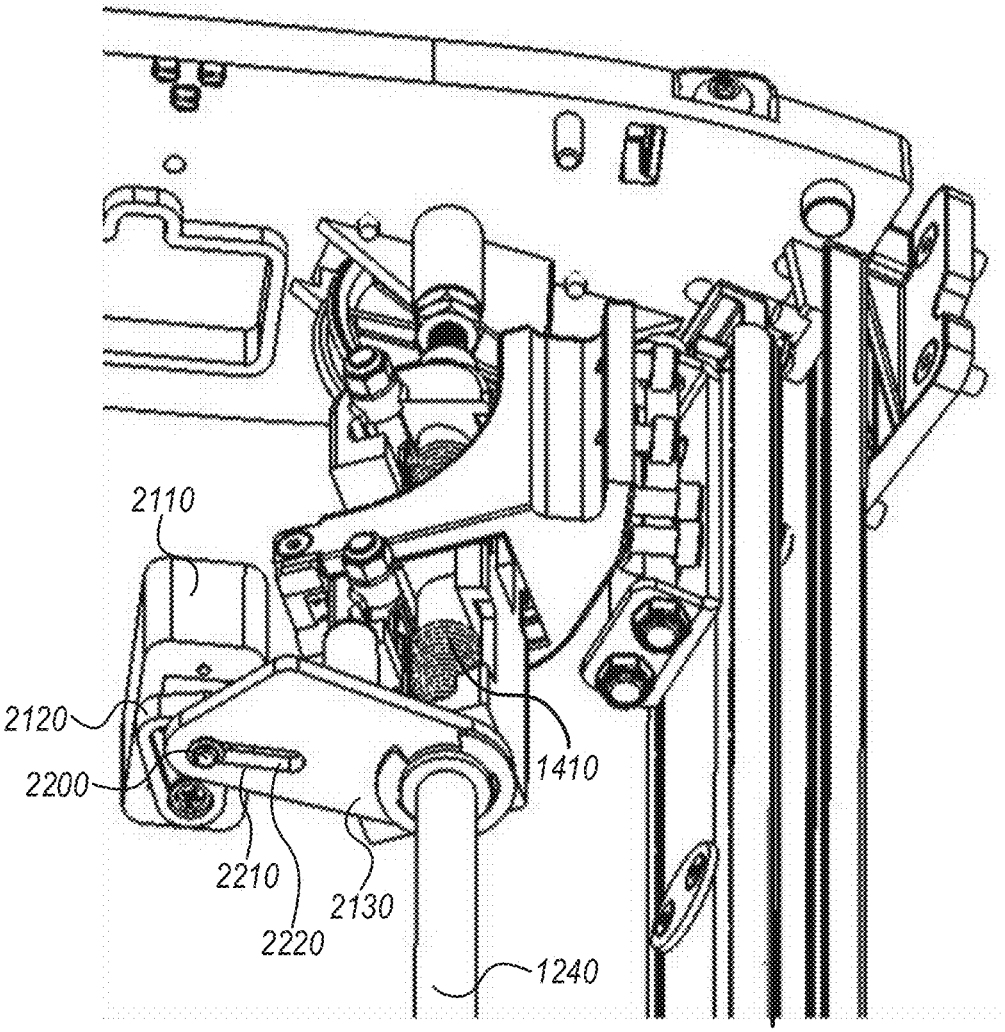
FIG. 22 is another perspective view of the brake assembly of FIG. 21.

FIG. 22 is another perspective view of the brake assembly 2100 of FIG. 21. As described in this document, the actuator 2110 can include the drive arm 2120, and the drive arm 2120 can be engaged with the control arm 2130. The drive arm 2120 can include a drive pin 2200, and the drive pin 2200 can extend from the drive arm 2120.

The control arm 2130 can include a slot 2210, and the slot 2210 can be sized and shaped to receive the drive pin 2200. Translation of the drive pin 2200 within the slot 2210 can displace the control arm 2130 relative to the lock rod 1240. For instance, the drive pin 2200 can engage with a wall 2220 of the slot 2210 to displace the control arm 2130 (e.g., rotate the control arm 2130 about the lock rod 1240. As shown in FIG. 22, the slot 2210 can have a linear profile. In some examples, the slot 2210 can have a curved profile.

VARIOUS NOTES & EXAMPLES

Aspect 1 may include or use subject matter (such as an apparatus, a system, a device, a method, a means for performing acts, or a device readable medium including instructions that, when performed by the device, may cause the device to perform acts), such as may include or use a height adjustable work surface, comprising: a work surface; a lock rod; a brake assembly sized and shaped to receive the lock rod and adapted to couple with the work surface, wherein the brake assembly is adapted to selectively translate with respect to the lock rod, the brake assembly including: a first torsion spring having a first inner portion; and a second torsion spring having a second inner portion, wherein: the first inner portion and the second inner portion are sized and shaped to receive the lock rod, the first torsion spring is adapted such that the first inner portion selectively engages with the lock rod, and the second torsion spring is adapted such that the second inner portion selectively engages with the lock rod, wherein the brake assembly includes a locked configuration, an unlocked configuration, and a safety configuration, wherein: in the locked configuration, the first inner portion is engaged with the lock rod, thereby preventing the translation of the brake assembly with respect to the lock rod, in the unlocked configuration, the first inner portion is disengaged from the lock rod, thereby allowing the translation of the brake assembly with respect to the lock rod, and in the safety configuration, the second inner portion is engaged with the lock rod, irrespective of whether the first inner portion is engaged with the lock rod, and thereby preventing the translation of the brake assembly with respect to the lock rod.

Aspect 2 may include or use, or may optionally be combined with the subject matter of Aspect 1, to optionally include or use a counterbalance mechanism adapted to support the work surface, wherein the counterbalance mechanism is coupled with a first leg of the second torsion spring such that the counterbalance mechanism supplies tension to the first leg of the second torsion spring, thereby disengaging the second inner portion from the lock rod.

Aspect 3 may include or use, or may optionally be combined with the subject matter of Aspect 2 to optionally include or use wherein the second inner portion of the second torsion spring engages with the lock rod when the counterbalance mechanism does not supply tension to the first leg of the second torsion spring.

Aspect 4 may include or use, or may optionally be combined with the subject matter of one or any combination of Aspects 2 or 3 to optionally include or use a tensile member coupling the first leg of the second torsion spring with the counterbalance mechanism, wherein a translation of the brake assembly with respect to the lock rod causes a corresponding translation of the tensile member with respect to the lock rod.

Aspect 5 may include or use, or may optionally be combined with the subject matter of one or any combination of Aspects 1 through 4 to optionally include or use an actuator coupled with a first leg of the first torsion spring, wherein a manipulation of the actuator from a first position to a second position causes the brake assembly to change from the locked configuration to the unlocked configuration.

Aspect 6 may include or use, or may optionally be combined with the subject matter of one or any combination of Aspects 1 through 5 to optionally include or use a first adjustment clip coupled with a second leg of the first torsion spring and the brake assembly, wherein the first adjustment clip is adapted to displace the second leg of the first torsion spring, thereby changing a dimension of the first inner portion.

Aspect 7 may include or use, or may optionally be combined with the subject matter of Aspect 6 to optionally include or use a second adjustment clip coupled with a second leg of the second torsion spring and the brake assembly, wherein the second adjustment clip is adapted to displace the second leg of the second torsion spring, thereby changing a dimension of the second inner portion.

Aspect 8 may include or use, or may optionally be combined with the subject matter of one or any combination of Aspects 1 through 7 to optionally include or use wherein the lock rod is a first lock rod and the brake assembly is a first brake assembly, and the first lock rod is positioned on a first side with respect to the work surface, and further comprising: a second lock rod positioned on a second side with respect to the work surface; and a second brake assembly sized and shaped to receive the second lock rod and adapted to couple with the work surface, wherein the second brake assembly is adapted to selectively translate with respect to the second lock rod, the second brake assembly including: a third torsion spring having a third inner portion sized and shaped to receive the second lock rod, the third torsion spring is adapted such that the third inner portion selectively engage with the lock rod, and wherein the second brake assembly includes a locked configuration and an unlocked configuration, wherein: in the locked configuration, the third inner portion is engaged with the second lock rod, thereby preventing the translation of the brake assembly with respect to the second lock rod, and in the unlocked configuration, the third inner portion is disengaged from the second lock rod, thereby allowing the translation of the second brake assembly with respect to the second lock rod.

Aspect 9 may include or use, or may optionally be combined with the subject matter of one or any combination of Aspects 1 through 8 to optionally include or use an actuator coupled with a first leg of the first torsion spring and a first leg of the third torsion spring, wherein manipulation of the actuator from a first position to a second position causes the first brake assembly and the second brake assembly to change from the locked configuration to the unlocked configuration.

Aspect 10 may include or use, or may optionally be combined with the subject matter of one or any combination of Aspects 1 through 9 to optionally include or use wherein a horizontal translation of the brake assembly causes a vertical translation of the work surface.

Aspect 11 may include or use, or may optionally be combined with the subject matter of one or any combination of Aspects 1 through 10 to optionally include or use wherein a vertical translation of the brake assembly causes a vertical translation of the work surface.

Aspect 12 may include or use, or may optionally be combined with the subject matter of one or any combination of Aspects 1 through 11 to optionally include or use a riser adapted to couple with a support structure, wherein the lock rod is coupled to the riser.

Aspect 13 may include or use, or may optionally be combined with the subject matter of one or any combination of Aspects 1 through 12 to optionally include or use a leg assembly including a first foot adapted to rest upon a foundation, wherein the lock rod is coupled with the first foot of the leg assembly, and wherein the brake assembly is adapted to translate substantially parallel with the foundation.

Aspect 14 may include or use, or may optionally be combined with the subject matter of one or any combination of Aspects 1 through 13 to optionally include or use a counterbalance mechanism adapted to support the work surface, wherein the lock rod and brake assembly are located proximate the counterbalance mechanism.

Aspect 15 may include or use subject matter (such as an apparatus, a system, a device, a method, a means for performing acts, or a device readable medium including instructions that, when performed by the device, may cause the device to perform acts), such as may include or use an actuator assembly, comprising: a lock rod, and a brake assembly sized and shaped to receive the lock rod and adapted to couple with a work surface, wherein the brake assembly is adapted to selectively translate with respect to the lock rod, the brake assembly including: a torsion spring having an inner portion, wherein the inner portion is sized and shaped to receive the lock rod, and the torsion spring is adapted such that the inner portion selectively engages with the lock rod, wherein the selective engagement of the inner portion with the lock rod prevents the translation of the brake assembly with respect to the lock rod, a first sliding bracket including a first angled surface, the first sliding bracket adapted to translate from a first position to a second position, and a second sliding bracket including a second angled surface and an actuation pad extending from the second sliding bracket, wherein: the first angled surface is adapted to slidably engage with the second angled surface, translation of the first sliding bracket causes a corresponding translation of the second sliding bracket, and the actuation pad is adapted to engage with a first leg of the torsion spring, and thereby selectively engage the inner portion of the torsion spring with the lock rod.

Aspect 16 may include or use, or may optionally be combined with the subject matter of Aspect 15, to optionally include or use wherein the slidable engagement of the first angled surface with the second angled surface causes the corresponding translation of the second sliding bracket.

Aspect 17 may include or use, or may optionally be combined with the subject matter of one or any combination of Aspects 15 or 16 to optionally include or use wherein the first sliding bracket is adapted to translate in a first direction and the second sliding bracket is adapted to translate in a second direction, and the second direction is perpendicular to the first direction.

Aspect 18 may include or use, or may optionally be combined with the subject matter of one or any combination of Aspects 15 through 17 to optionally include or use wherein the first sliding bracket is in the first position, and the inner portion is engaged with the lock rod.

Aspect 19 may include or use, or may optionally be combined with the subject matter of one or any combination of Aspects 15 through 18 to optionally include or use wherein the first sliding bracket is in the second position, and the inner portion is disengaged from the lock rod.

Aspect 20 may include or use, or may optionally be combined with the subject matter of one or any combination of Aspects 15 through 19 to optionally include or use a compression spring adapted to bias the first sliding bracket toward the first position.

Aspect 21 may include or use, or may optionally be combined with the subject matter of Aspect 20 to optionally include or use wherein the torsion spring and the compression spring cooperate such that the inner portion is biased toward engagement with the lock rod.

Aspect 22 may include or use, or may optionally be combined with the subject matter of one or any combination of Aspects 15 through 21 to optionally include or use an adjustment clip coupled with a second leg of the torsion spring and the brake assembly, wherein the adjustment clip is adapted to displace the second leg of the torsion spring, thereby changing a dimension of an inner portion of the torsion spring.

Aspect 23 may include or use subject matter (such as an apparatus, a system, a device, a method, a means for performing acts, or a device readable medium including instructions that, when performed by the device, may cause the device to perform acts), such as may include or use a height adjustable platform, comprising: a work surface; a lock rod; a brake assembly sized and shaped to receive the lock rod and adapted to couple with the work surface, wherein the brake assembly is adapted to selectively translate with respect to the lock rod, the brake assembly including: a torsion spring having an inner portion, wherein the inner portion is sized and shaped to receive the lock rod, wherein the torsion spring is adapted such that the inner portion selectively engages with the lock rod, wherein the brake assembly includes a locked configuration, and an unlocked configuration: in the locked configuration, the inner portion is engaged with the lock rod, thereby preventing the translation of the brake assembly with respect to the lock rod, in the unlocked configuration, the inner portion is disengaged from the lock rod, thereby allowing the translation of the brake assembly with respect to the lock rod; and an adjustment mechanism adapted to displace a leg of the torsion spring, thereby changing a dimension of the inner portion.

Aspect 24 may include or use, or may optionally be combined with the subject matter of Aspect 23, to optionally include or use wherein the adjustment mechanism includes a collar, and the collar is adapted to rotate about the lock rod, and rotation of the collar about the lock rod displaces the leg of the torsion spring. Aspect 25 may include or use, or may optionally be combined with the subject matter of one or any combination of Aspects 23 or 24 to optionally include or use wherein the lock rod is a first lock rod and the brake assembly is a first brake assembly, and the first lock rod is positioned on a first side with respect to the work surface, and further comprising: a second lock rod positioned on a second side with respect to the work surface; and a second brake assembly adapted to receive the second lock rod.

Aspect 26 may include or use, or may optionally be combined with any portion or combination of any portions of any one or more of Aspects 1 through 25 to include or use, subject matter that may include means for performing any one or more of the functions of Aspects 1 through 25.

Each of these non-limiting aspects can stand on its own, or can be combined in various permutations or combinations with one or more of the other examples.

The above description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A height adjustable work surface, comprising:
- a work surface;
- a lock rod;
- a brake assembly sized and shaped to receive the lock rod and adapted to couple with the work surface, wherein the brake assembly is adapted to selectively translate with respect to the lock rod, the brake assembly including:
  - a first torsion spring having a first inner portion; and
  - a second torsion spring having a second inner portion, wherein:
    - the first inner portion and the second inner portion are sized and shaped to receive the lock rod,
    - the first torsion spring is adapted such that the first inner portion selectively engages with the lock rod, and
    - the second torsion spring is adapted such that the second inner portion selectively engages with the lock rod, wherein the brake assembly includes a locked configuration, an unlocked configuration, and a safety configuration, wherein:
      - in the locked configuration, the first inner portion is engaged with the lock rod, thereby preventing the translation of the brake assembly with respect to the lock rod,
      - in the unlocked configuration, the first inner portion is disengaged from the lock rod, thereby allowing the translation of the brake assembly with respect to the lock rod, and
      - in the safety configuration, the second inner portion is engaged with the lock rod, irrespective of whether the first inner portion is engaged with the lock rod, and thereby preventing the translation of the brake assembly with respect to the lock rod.

2. The height adjustable work surface of claim 1, further comprising:
- a counterbalance mechanism adapted to support the work surface, wherein the counterbalance mechanism is coupled with a first leg of the second torsion spring such that the counterbalance mechanism supplies tension to the first leg of the second torsion spring, thereby disengaging the second inner portion from the lock rod.

3. The height adjustable work surface of claim 2, wherein the second inner portion of the second torsion spring engages with the lock rod when the counterbalance mechanism does not supply tension to the first leg of the second torsion spring.

4. The height adjustable work surface of claim 2, further comprising:

a tensile member coupling the first leg of the second torsion spring with the counterbalance mechanism, wherein a translation of the brake assembly with respect to the lock rod causes a corresponding translation of the tensile member with respect to the lock rod.

5. The height adjustable work surface of claim 1, further comprising:

an actuator coupled with a first leg of the first torsion spring, wherein a manipulation of the actuator from a first position to a second position causes the brake assembly to change from the locked configuration to the unlocked configuration.

6. The height adjustable work surface of claim 1, further comprising:

a first adjustment clip coupled with a second leg of the first torsion spring, wherein the first adjustment clip is adapted to displace the second leg of the first torsion spring, thereby changing a dimension of the first inner portion.

7. The height adjustable work surface of claim 6, further comprising:

a second adjustment clip coupled with a second leg of the second torsion spring, wherein the second adjustment clip is adapted to displace the second leg of the second torsion spring, thereby changing a dimension of the second inner portion.

8. The height adjustable work surface of claim 1, wherein the lock rod is a first lock rod and the brake assembly is a first brake assembly, and the first lock rod is positioned on a first side with respect to the work surface, and further comprising:

a second lock rod positioned on a second side with respect to the work surface; and a second brake assembly sized and shaped to receive the second lock rod and adapted to couple with the work surface, wherein the second brake assembly is adapted to selectively translate with respect to the second lock rod, the second brake assembly including:

a third torsion spring having a third inner portion sized and shaped to receive the second lock rod, the third torsion spring is adapted such that the third inner portion selectively engage with the lock rod, and wherein the second brake assembly includes a locked configuration and an unlocked configuration, wherein:

in the locked configuration, the third inner portion is engaged with the second lock rod, thereby preventing the translation of the brake assembly with respect to the second lock rod, and in the unlocked configuration, the third inner portion is disengaged from the second lock rod, thereby allowing the translation of the second brake assembly with respect to the second lock rod.

9. The height adjustable work surface of claim 8, further comprising:

an actuator coupled with a first leg of the first, torsion spring and a first leg of the third torsion spring, wherein manipulation of the actuator from a first position to a second position causes the first brake assembly and the second brake assembly to change from the locked configuration to the unlocked configuration.

10. The height adjustable work surface of claim 1, wherein a horizontal translation of the brake assembly causes a vertical translation of the work surface.

11. The height adjustable work surface of claim 1, wherein a vertical translation of the brake assembly causes a vertical translation of the work surface.

12. The height adjustable work surface of claim 1, further comprising:

a riser adapted to couple with a support structure, wherein the lock rod is coupled to the riser.

13. The height adjustable work surface of claim 1, further comprising:

a leg assembly including a first foot adapted to rest upon a foundation, wherein the lock rod is coupled with the first foot of the leg assembly, and wherein the brake assembly is adapted to translate substantially parallel with the foundation.

14. The height adjustable work surface of claim 1, further comprising:

a counterbalance mechanism adapted to support the work surface, wherein the lock rod and brake assembly are located proximate the counterbalance mechanism.

* * * * *